US007404396B2

(12) United States Patent
Toriyama et al.

(10) Patent No.: US 7,404,396 B2
(45) Date of Patent: Jul. 29, 2008

(54) MULTIPLE DISCHARGE IGNITION CONTROL APPARATUS AND METHOD FOR INTERNAL COMBUSTION ENGINES

(75) Inventors: Makoto Toriyama, Chiryu (JP); Yuki Yamauchi, Kariya (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/700,900

(22) Filed: Feb. 1, 2007

(65) Prior Publication Data

US 2007/0181110 A1 Aug. 9, 2007

(30) Foreign Application Priority Data

Feb. 8, 2006 (JP) ..... 2006-030532
Oct. 27, 2006 (JP) ..... 2006-292549

(51) Int. Cl.
*F02P 15/10* (2006.01)

(52) U.S. Cl. ..... 123/598; 123/604; 123/605; 123/620; 123/637; 123/644; 123/655; 123/656

(58) Field of Classification Search ..... 123/598, 123/604, 605, 606, 620, 637, 644, 653–656
See application file for complete search history.

(56) References Cited

U.S. PATENT DOCUMENTS

| | | | | |
|---|---|---|---|---|
| 5,056,496 | A | 10/1991 | Morino et al. | 123/604 |
| 6,557,537 | B2 * | 5/2003 | Ikeda et al. | 123/606 |
| 6,675,784 | B2 * | 1/2004 | Nagase et al. | 123/603 |
| 6,725,834 | B2 * | 4/2004 | Yorita et al. | 123/637 |
| 7,100,589 | B2 * | 9/2006 | Toriyama | 123/604 |
| 7,121,270 | B1 | 10/2006 | Plotnikov | 123/604 |

FOREIGN PATENT DOCUMENTS

JP 8-4637 1/1996

* cited by examiner

*Primary Examiner*—T. M Argenbright
(74) *Attorney, Agent, or Firm*—Nixon & Vanderhye P.C.

(57) ABSTRACT

In a multiple discharge ignition control apparatus, a battery, an energy storage coil and a first IGBT are connected in series. Further, the energy storage coil, a diode, a primary coil and a second IGBT are connected in series. The energy storage coil is connected with a capacitor through the diode, and a secondary coil is connected with a spark plug and a resistor for current detection. An ignition control circuit switches the IGBTs between ON and OFF each time the secondary current detected by the resistor reaches a positive or negative discharge holding current in multiple discharge operation. A booster circuit is provided in addition to the energy storage coil and its output is feedback-controlled.

20 Claims, 14 Drawing Sheets

MULTIPLE DISCHARGE IGNITION CONTROL APPARATUS AND METHOD FOR INTERNAL COMBUSTION ENGINES

CROSS REFERENCE TO RELATED APPLICATION

This application relates to and incorporates herein by reference Japanese Patent Applications No. 2006-30532 filed on Feb. 8, 2006 and No. 2006-292549 filed on Oct. 27, 2006.

FIELD OF THE INVENTION

The present invention relates to multiple discharge ignition control apparatus and method for internal combustion engines and in particular to multiple discharge ignition control apparatus and method for internal combustion engines that effects ignition discharge at a spark plug multiple times in one combustion stroke of each cylinder.

BACKGROUND OF THE INVENTION

In a spark ignition internal combustion engine, ignition discharge is effected at a spark plug by an ignition device including an ignition coil and the like, and fuel, guided into a combustion chamber, is burned by this ignition discharge. To make the combustion condition more desirable, multiple discharge is proposed to effect ignition discharges at a spark plug more than once in one combustion stroke of each cylinder. Thus, ignition discharge is repeatedly effected at a spark plug during a predetermined multiple discharge period.

For example, U.S. Pat. No. 5,056,496 (JP 2811781) discloses an ignition system, which is a combination of a capacitive discharge ignition device and a multiple discharge ignition device. In this system, a battery, an energy storage coil, and a first switch are connected in series, and the energy storage coil, a reverse-flow prevention device, a primary coil of an ignition coil, and a second switch are connected in series. The energy storage coil is connected with a capacitor through the reverse-flow prevention device, and the secondary coil of the ignition coil is connected with a spark plug.

With this construction, after the energy storage coil and the capacitor are charged, the energy storage coil and the capacitor are discharged to charge the ignition coil. At the same time, initial ignition discharge is effected at the spark plug. Thereafter, the first and second switches are periodically and alternately turned on and off. Thus, the energy storage coil is charged and the ignition coil is discharged. Meanwhile, the ignition coil is charged and the energy storage coil is discharged. Thus, a current is supplied through the secondary side of the ignition coil both in the forward direction and in the reverse direction to effect ignition discharge repeatedly at the spark plug. Multiple discharge is thereby carried out.

Some of recent engines have been improved to increase in-cylinder flow velocity of air-fuel mixture gas for the improvement of combustion condition. In such a case, the flow velocity of gas around the spark plug is increased, and this increases a voltage required to hold ignition discharge. In an ultra-lean burn engine or the like with its air-fuel ratio significantly made lean, the flow velocity of gas around a spark plug is further increased. It is required to supply a large current through the spark plug. In such an environment, a required secondary current cannot be ensured.

In addition, since the flow velocity of gas in proximity to a spark plug is high in such engines, ignition discharge can vanish during multiple discharge. To cope with this, a power supply system connected to the primary coil is provided with a booster circuit such as a DC/DC converter. However, in the booster circuit, variation is produced in coil inductance or the like due to an individual difference, change over time, or the like, which can lead to excess or deficiency in energy supplied to the primary coil of the ignition coil. If there is produced excess or deficiency in energy supplied to the primary coil, that makes spark discharge at a spark plug unstable.

SUMMARY OF THE INVENTION

It is therefore an object of the invention to provide multiple discharge ignition control apparatus and method for internal combustion engines, wherein a current of sufficient intensity to be supplied through a spark plug in multiple discharge can be ensured.

According to one aspect of the present invention, in a multiple discharge ignition control for internal combustion engines, an ignition time signal is generated at an ignition time, and a primary current is supplied to a primary coil of an ignition coil in response to the ignition time signal thereby to generate a secondary current in the secondary coil for starting ignition by a spark plug. Following the ignition time signal, a multiple discharge period signal is generated, and alternate turning on and off of energization of the primary coil is repeated during the multiple discharge period signal to generate the secondary current in the secondary coil both in a forward direction and in a reverse direction to carry out multiple discharge in the spark plug. The secondary current is detected, and the turning on and off of the energization of the primary coil is switched each time the secondary current reaches a predetermined discharge holding current value in the multiple discharge. The discharge holding current value may be varied in accordance with an engine operation state related to an in-flow speed of air-fuel mixture gas near the spark plug.

According to another aspect of the present invention, in a multiple discharge ignition control for internal combustion engines, an ignition time signal is generated at an ignition time, and a primary current is supplied to a primary coil of an ignition coil in response to the ignition time signal thereby to generate a secondary current in the secondary coil for starting ignition by a spark plug. Following the ignition time signal, a multiple discharge period signal is generated, and alternate turning on and off of energization of the primary coil is repeated during the multiple discharge period signal to generate the secondary current in the secondary coil both in a forward direction and in a reverse direction to carry out multiple discharge in the spark plug. During the turning on of the primary coil in the multiple discharge period, a booster circuit including a plurality of boosting elements supplies booster circuit currents. A total sum of the booster circuit currents is detected at a location where the plurality of boosting elements is integrated, and the turn-on/off of the boosting elements is controlled based on the total sum of the currents of the plurality of boosting elements.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

The present invention will be described in detail with reference to various embodiments, in which a multiple discharge ignition control apparatus is provided for internal combustion engines. In this control apparatus, a spark plug is provided to generate a discharge spark under an ignition command from an electronic control unit (ECU).

First Embodiment

Figure 1:
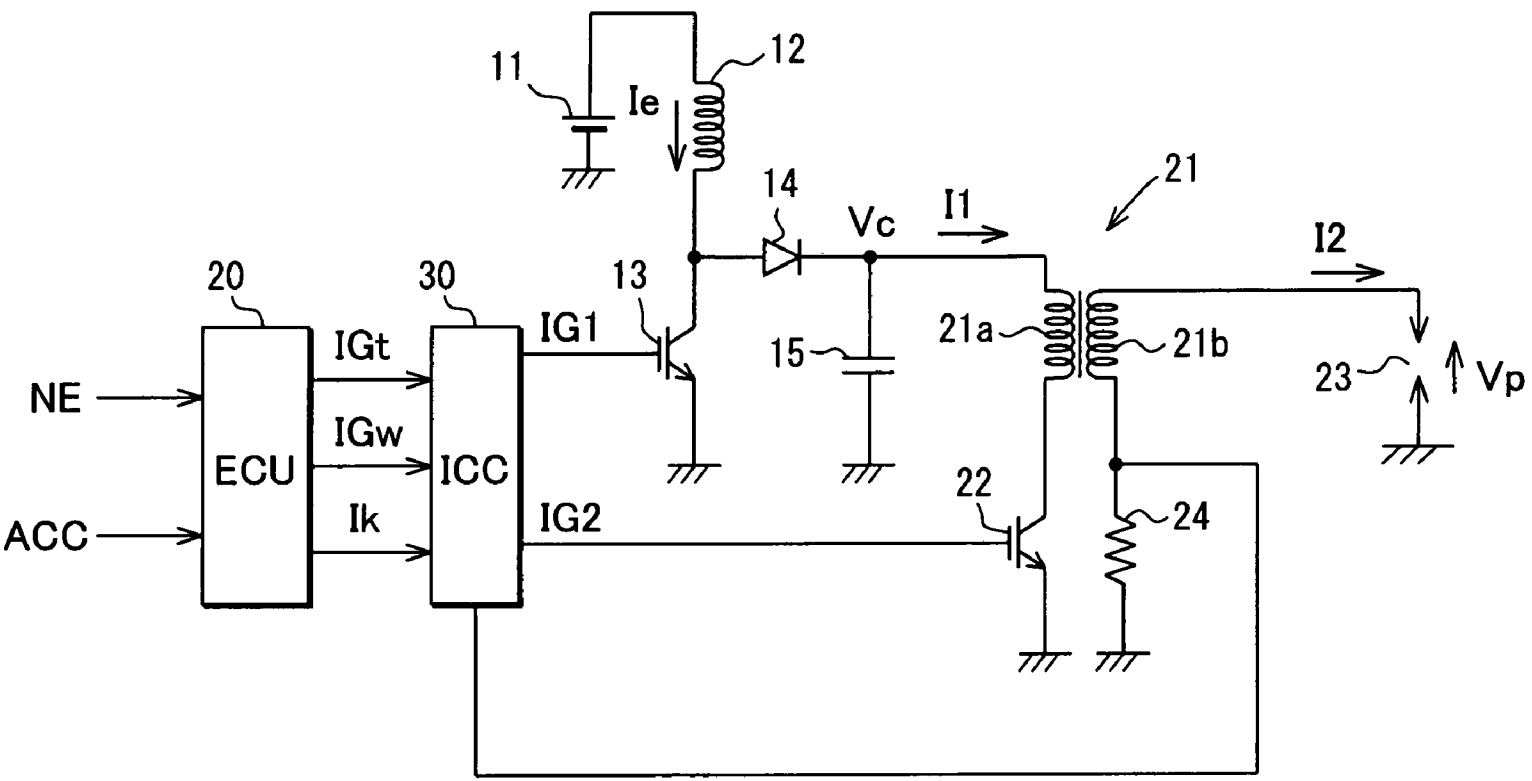
FIG. 1 is a block diagram illustrating a multiple discharge ignition control apparatus according to a first embodiment of the invention.

Referring first to FIG. 1, a battery 11 as a direct-current power source is connected in series with an energy storage coil 12 and a first IGBT 13. When the IGBT 13 is ON, electrical energy is stored in the energy storage coil 12. Between the energy storage coil 12 and the IGBT 13, a capacitor 15 is connected for capacitive discharge through a diode 14. This capacitor 15 is charged with the electrical energy stored in the energy storage coil 12.

An ignition coil 21 provided for each cylinder of the engine is constructed with a primary coil 21*a* and a secondary coil 21*b*. One end of each primary coil 21*a* is connected with the capacitor 15, and the other end is connected with a second IGBT 22. As a result of this IGBT 22 being turned on/off, the electrical energy stored in the energy storage coil 12 and the capacitor 15 is released, and a primary current I1 is supplied through the primary coil 21*a* thus energizing the primary coil 21*a*. One end of each secondary coil 21*b* is connected with a spark plug 23, and the other end is connected with a resistor 24 for current detection. When a current is supplied through the primary coil 21*a*, a secondary current I2 is supplied through the secondary coil 21*b* in conjunction therewith. Then, ignition discharge is caused to occur at the spark plug 23 by supply of discharge energy from the ignition coil 21 (application of high voltage). Here, charging voltage for the capacitor 15 is designated as Vc, and the terminal-to-terminal voltage of the spark plug 23 is designated as a plug voltage Vp. The current supplied through the energy storage coil 12 is designated as charging current Ie. When the direction of a flow from the battery 11 to the primary coil 21*a* is taken as positive, the current supplied through the primary coil 21*a* will be taken as primary current I1. When the direction of a flow from the secondary coil 21*b* to the spark plug 23 is positive, the current (plug current) supplied through the secondary coil 21*b* will be taken as secondary current I2.

As is known, ECU 20 is constructed based on a microcomputer constructed of CPU, RAM, ROM, and the like. It executes various control programs stored in the ROM, and thereby controls the various states of engine operation. In ignition timing control, the ECU 20 acquires operation state information indicating the state of engine operation, such as engine rotational speed NE and an amount of accelerator operation ACC, and computes optimum ignition timing based on this operation state information. Then, it generates an ignition signal IGt according to this ignition timing, and outputs it to an ignition control circuit 30. In this ignition control apparatus, multiple discharge control is carried out to make the combustion condition more desirable. That is, ignition discharge is effected at the spark plug 23 more than once (multiple times) in one combustion stroke. For this purpose, the ECU 20 computes a multiple discharge period for which ignition discharge should be repeatedly effected, based on the operation state information. Then, it generates a multiple discharge period signal IGw that defines the multiple discharge period, and outputs it to the ignition control circuit (ICC) 30.

Based on the ignition signal IGt and multiple discharge period signal IGw inputted from the ECU 20, the ignition control circuit 30 outputs driving signals IG1 and IG2 for respectively turning on/off the IGBTs 13, 22. More specifically, the ignition control circuit 30 outputs the driving signals IG1 and IG2 in accordance with the ignition signal IGt to respectively turn on/off the IGBTs 13, 22, and causes ignition discharge to occur with the ignition timing. Thereafter, it repeatedly turns on/off the IGBTs 13, 22 during the multiple discharge period according to the multiple discharge period signal IGw, and thereby repeatedly causes ignition discharge to occur.

Figure 2:
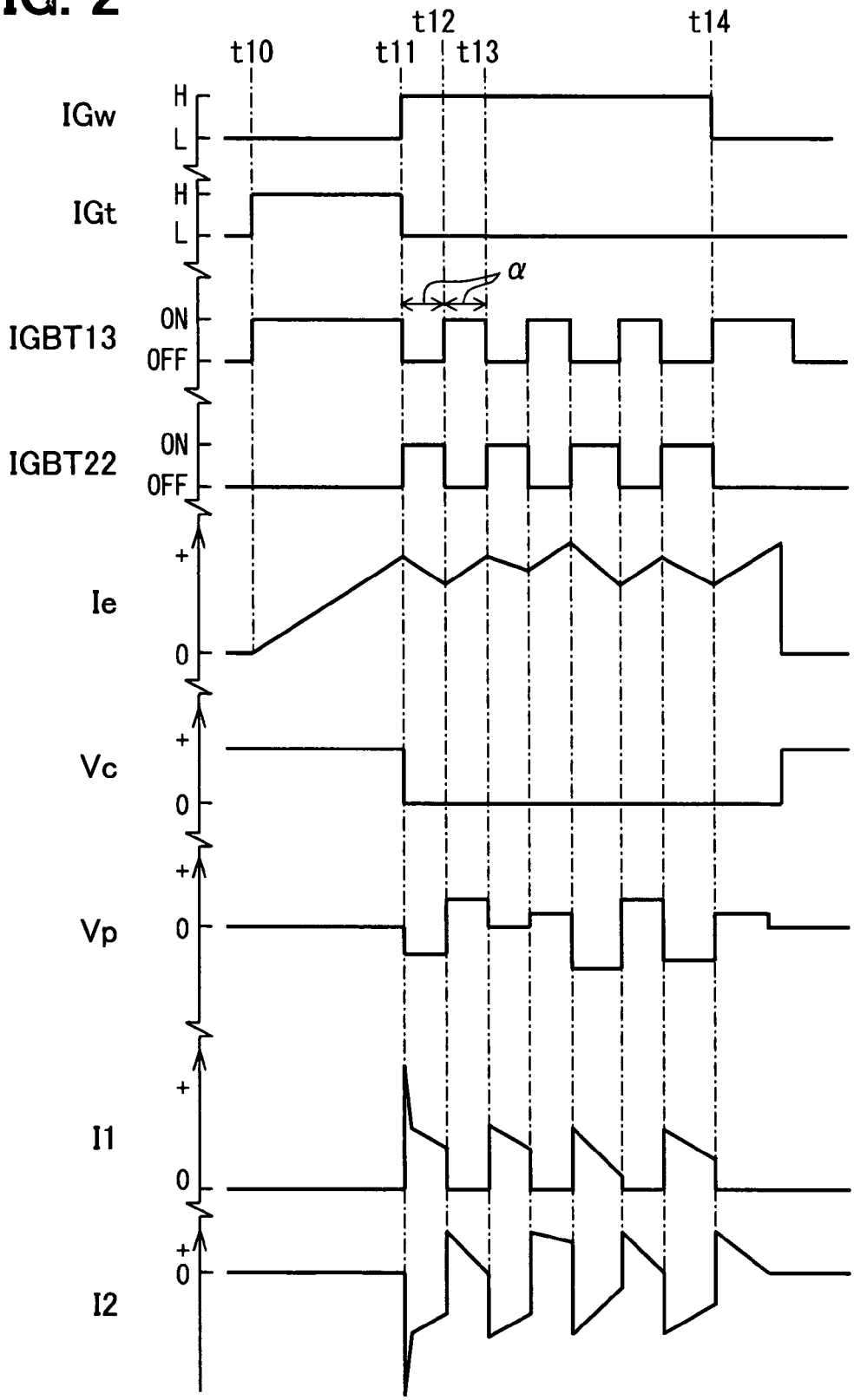
FIG. 2 is a signal diagram illustrating igniting operation performed when IGBTs are switched between ON and OFF according to a certain switching time in the first embodiment.

General igniting operation for effecting multiple discharge is shown in FIG. 2. In this example, initial ignition discharge is effected at time t11 as an ignition time, and discharge is repeatedly effected during the period from time t11 to time t14 as a multiple discharge period. In this period, the IGBTs 13, 22 are turned on/off at certain switching time intervals $\alpha$.

First, the ignition signal IGt is raised to the H level at time t10 before the ignition time t11 comes. In response to that, the IGBT 13 is turned on, and a charging current Ie is supplied and the energy storage coil 12 is charged. When the ignition signal IGt is lowered to the L level at time t11 as the ignition time, the IGBT 13 is turned off and the IGBT 22 is turned on. As a result, electrical energy is simultaneously supplied from the energy storage coil 12 and the capacitor 15 to the primary coil 21*a*. In conjunction with this, high voltage is induced in the secondary coil 21*b*, and negative high voltage is applied as plug voltage Vp to the spark plug 23. As a result, ignition discharge occurs at the spark plug 23, and the secondary current I2 flows in the negative direction. Thereafter, during the periods for which the IGBT 22 is ON, electrical energy is supplied from the energy storage coil 12. Thus, ignition discharge continuously occurs at the spark plug 23, and the primary current I1 flows and the ignition coil 21 is charged.

At time t11, the multiple discharge period signal IGw is raised to the H level. For this reason, after time t11, the IGBTs 13, 22 are alternately turned on/off, and ignition discharge is repeatedly effected at the spark plug 23. That is, at time t12 when the switching time interval a has passed after time t11, the IGBT 13 is turned on and the IGBT 22 is turned off. Thus, the energy storage coil 12 is charged again, and positive plug voltage Vp is applied to the spark plug 23 in conjunction with discharging of the ignition coil 21. As a result, ignition discharge occurs at the spark plug 23, and the secondary current I2 flows in the positive direction. At time t13 when another switching time interval a has passed, the IGBT 13 is turned off and the IGBT 22 is turned on. Thus, electrical energy is supplied again from the energy storage coil 12 to the ignition coil 21, and ignition discharge occurs at the spark plug 23 and the ignition coil 21 is charged again.

Thereafter, the IGBTs 13, 22 are switched between ON and OFF at switching time intervals $\alpha$ and ignition discharge repeatedly occurs at the spark plug 23 until the multiple discharge period signal IGw is lowered to the L level. At this time, the plug voltage Vp fluctuates by the air-fuel mixture gas flow in proximity to the spark plug 23. The secondary current I2 varies according to the magnitude of the plug voltage Vp. It is thus reduced more quickly with increase in the magnitude of the plug voltage Vp. After the multiple discharge period signal IGw is lowered to the L level at time t14, the IGBT 13 is temporarily turned on.

In control in which the IGBTs 13, 22 are switched between ON and OFF at certain switching time intervals $\alpha$, the flow velocity of gas in proximity to the spark plug 23 is increased. In cases where the plug voltage Vp required for effecting ignition discharge is increased (e.g., 0.5 to 1.5 kV or so), it is likely that the secondary current I2 falls below a current value (e.g., 10 to 20 mA or so) required for effecting ignition discharge. To cope with this, a discharge holding current Ik is set as the magnitude of the secondary current I2 required for effecting ignition discharge in multiple discharge; and the ignition control circuit 30 is so constructed that the IGBTs 13, 22 are switched between ON and OFF each time the secondary current I2 reaches the positive or negative discharge holding current +Ik, −Ik.

Figure 3:
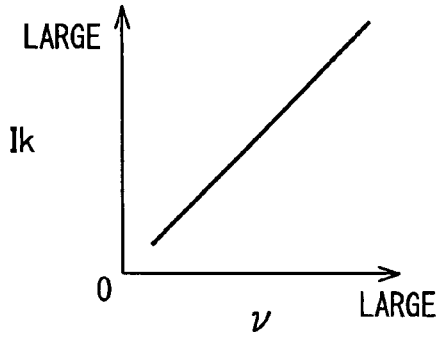
FIG. 3 is a graph illustrating the relation between gas flow velocity and discharge holding current.

The discharge holding current Ik varies according to the flow velocity $\nu$ of gas. As illustrated in FIG. 3, the discharge holding current Ik tends to increase with increase in flow velocity $\nu$. For this reason, it is desirable that a discharge holding current Ik should be set according to the flow velocity $\nu$. Since it is difficult to directly detect the flow velocity $\nu$ of gas in each cylinder, however, a discharge holding current Ik is set based on information on the state of engine operation in correlation with flow velocity $\nu$ as described below.

Figure 4A:
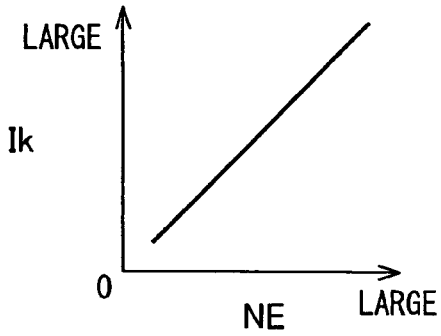
FIGS. 4A and 4B are graphs illustrating the relation between information on the state of engine operation and discharge holding current.
Figure 4B:
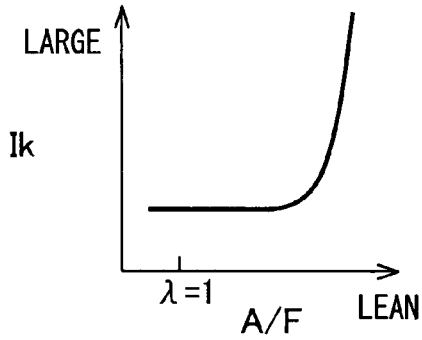

FIGS. 4A and 4B illustrate the relation between information on the state of engine operation in correlation with flow velocity $\nu$ and discharge holding current Ik. FIG. 4A illustrates the relation between discharge holding current Ik and engine rotational speed SPD as a kind of information on the state of engine operation. FIG. 4B illustrates the relation between discharge holding current Ik and the degree of lean in air-fuel ratio A/F as a kind of information on the state of engine operation. In FIG. 4B, the stoichiometric air-fuel ratio is designated as $\lambda=1$. As illustrated in FIG. 4A, the discharge holding current Ik is low when the engine rotational speed is low, and the discharge holding current Ik is increased with increase in the engine rotational speed. This is because as the engine rotational speed is increased, the reciprocating motion of a piston is accelerated and the flow velocity $\nu$ is increased. As illustrated in FIG. 4B, the discharge holding current Ik is substantially constant until the degree of lean in air-fuel ratio reaches some extent. As the air-fuel ratio further becomes lean, the discharge holding current Ik is increased. The reason for this is as follows: in lean burn in which the degree of lean in air-fuel ratio is high, the burning velocity is enhanced by generating a swirl or tumble flow to induce turbulence (disturbance). Therefore, the flow velocity $\nu$ is more increased as the air-fuel ratio becomes lean.

Figure 5:
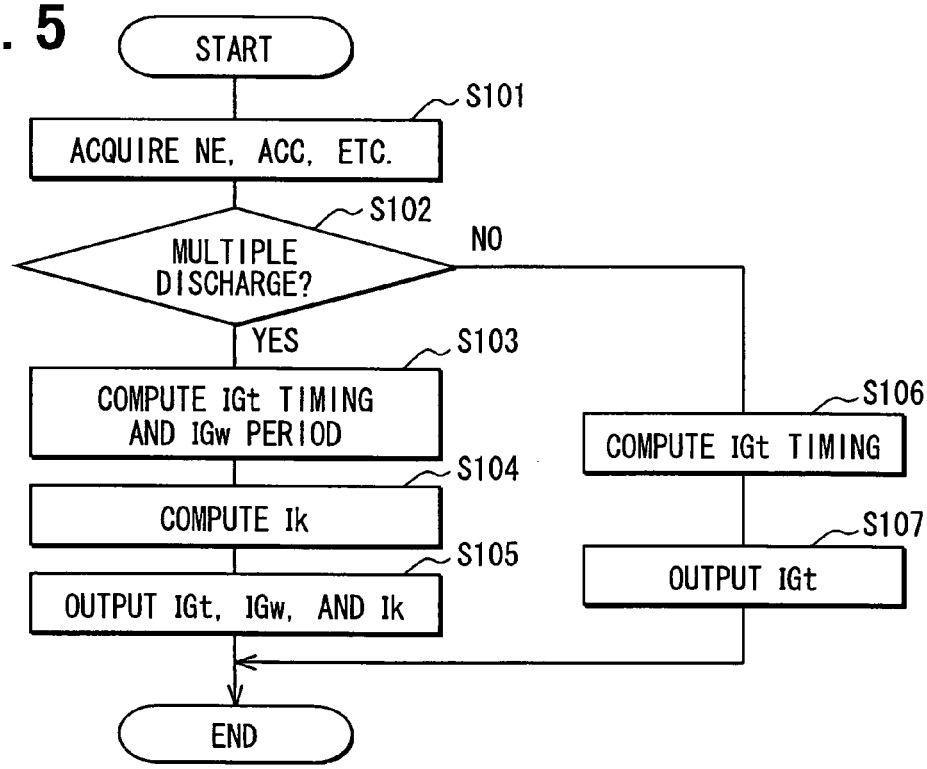
FIG. 5 is a flowchart illustrating a procedure for ignition timing control in the first embodiment.

The processing illustrated in FIG. 5 is carried out by the ECU 20 at predetermined time intervals. First, the ECU 20 acquires information on the state of engine operation, such as engine rotational speed NE and an amount of accelerator operation ACC at step S101. At step S102, subsequently, it determines whether to effect multiple discharge based on the operation state information. Specifically, when the state of engine operation is low revolution and low load or on other like occasions, the ECU 20 determines that multiple discharge should be effected.

In cases where multiple discharge is to be effected, the ECU 20 proceeds to step S103 and computes optimum ignition timing (IGt timing) and multiple discharge period (IGw period) based on the information on the state of engine operation. At step S104, the ECU 20 computes a discharge holding current Ik based on the information on the state of engine operation. At step S105, it generates an ignition signal IGt and a multiple discharge period signal IGw corresponding to the ignition timing and the multiple discharge period, and outputs them to the ignition control circuit 30. At the same time, it outputs a command for the discharge holding current Ik to the ignition control circuit 30. In cases where multiple discharge is not effected, the ECU 20 computes ignition timing at step S106. Further, it generates an ignition signal IGt and outputs it to the ignition control circuit 30 at step S107.

Figure 6:
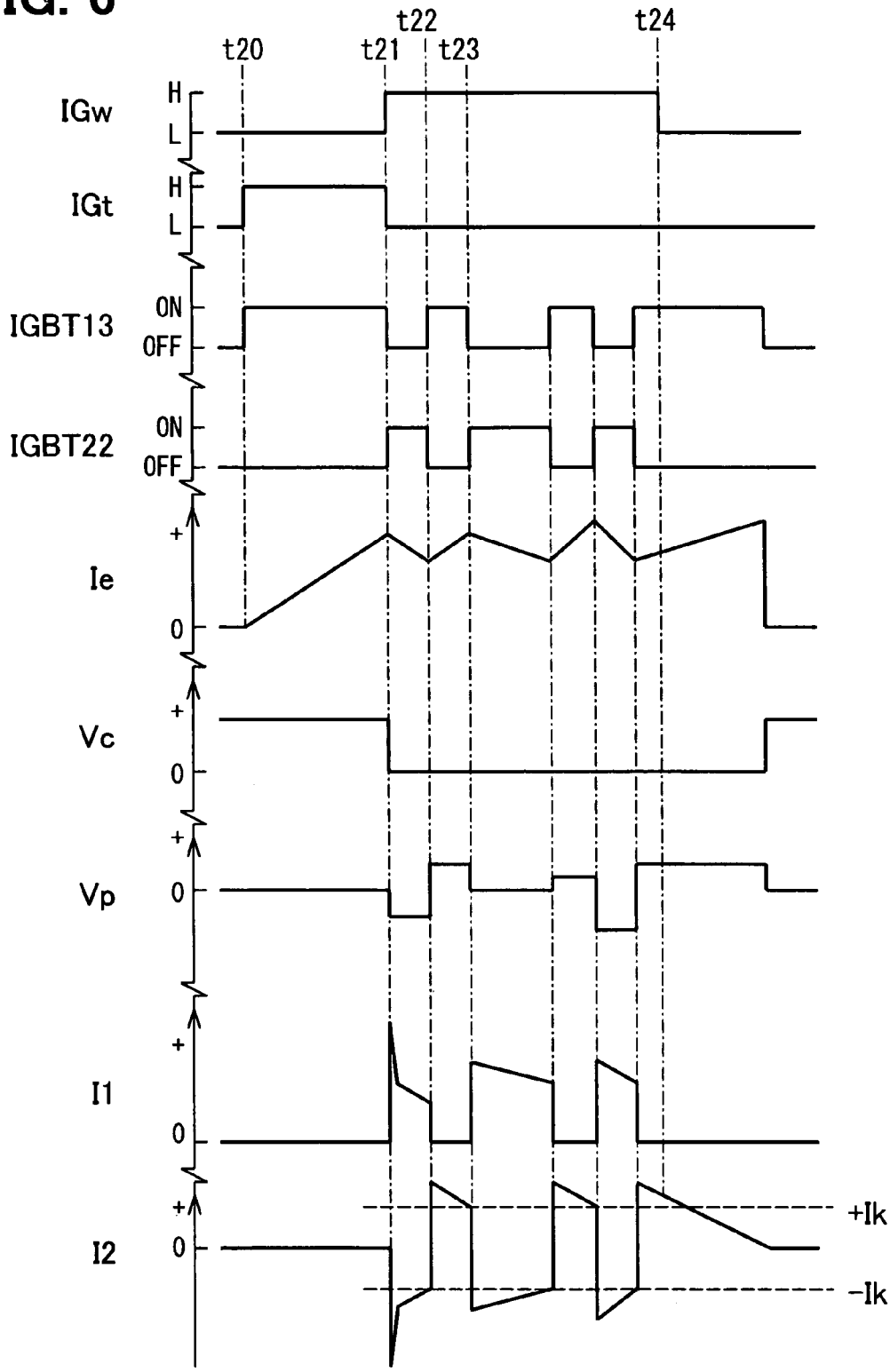
FIG. 6 is a signal diagram illustrating igniting operation in the first embodiment.

In the example illustrated in FIG. 6, initial ignition discharge is effected at time t21 as an ignition timing (IGt timing), and ignition discharge is repeatedly effected during the period from time t21 to time t24 as a multiple discharge period.

During the period from time t20 to time t21 before the ignition time comes, the IGBT 13 is turned on according to the ignition signal IGt, and the charging current Ie is supplied and the energy storage coil 12 is charged. At time t21 as the ignition time, the IGBT 13 is turned off and the IGBT 22 is turned on. Then, electrical energy is supplied from the energy storage coil 12 and the capacitor 15, and initial ignition discharge occurs at the spark plug 23. The secondary current I2 flows in the negative direction. This secondary current I2 is detected by the resistor 24 and fed back to the ignition control circuit 30.

Thereafter, the electrical energy is consumed by the ignition discharge at the spark plug 23, and the secondary current I2 is thereby gradually reduced. At this time, a discharge holding current Ik has been set based on information on the state of engine operation, such as rotational speed and air-fuel ratio. When the secondary current I2 reaches the negative discharge holding current −Ik at time t22, the IGBT 13 is turned on and the IGBT 22 is turned off. Thus, ignition discharge occurs at the spark plug 23 in conjunction with the discharging of the ignition coil 21, and at the same time, the energy storage coil 12 is charged. Thereafter, the secondary current I2 is reduced again. When the secondary current I2 reaches the positive discharge holding current +Ik at time t23, the IGBT 13 is turned on and the IGBT 22 is turned on. Thus, ignition discharge is caused to occur at the spark plug 23 by the supply of electrical energy from the energy storage coil 12, and at the same time, the ignition coil 21 is charged.

Hereafter, the IGBTs 13, 22 are switched between ON and OFF each time the secondary current I2 reaches the positive or negative discharge holding current +Ik, −Ik and ignition discharge repeatedly occurs at the spark plug 23 until the multiple discharge period signal IGw is lowered to the L level at time t24.

In multiple discharge performed in the first embodiment, the secondary current I2 supplied through the secondary coil 21*b* of the ignition coil 21 is detected, and the IGBTs 13, 22 are switched between ON and OFF each time the detection value reaches the positive or negative discharge holding current +Ik, −Ik. Thus, when the secondary current I2 is reduced and becomes equal to the positive or negative discharge holding current +Ik, −Ik, the primary current I1 is inverted and the secondary current I2 is newly supplied. As a result, the secondary current I2 can be kept at the discharge holding current Ik or higher.

Further, the discharge holding current Ik is set based on information in correlation with in-cylinder gas flow velocity v. As a result, the magnitude of the secondary current I2 to be ensured can be adjusted according to the flow velocity v. Therefore, even when the flow velocity v is increased, the secondary current I2 required for ignition discharge can be satisfactorily ensured.

Second Embodiment

A second embodiment is constructed to meet ultra-lean burn engine, in which an air-fuel ratio is significantly made lean. Therefore the plug voltage required for effecting ignition discharge is 2 to 5 kV or so and the discharge holding current required for the same is 50 to 100 mA or so. The second embodiment has a DC/DC converter as power supply means for boosting and outputting battery voltage.

Figure 7:
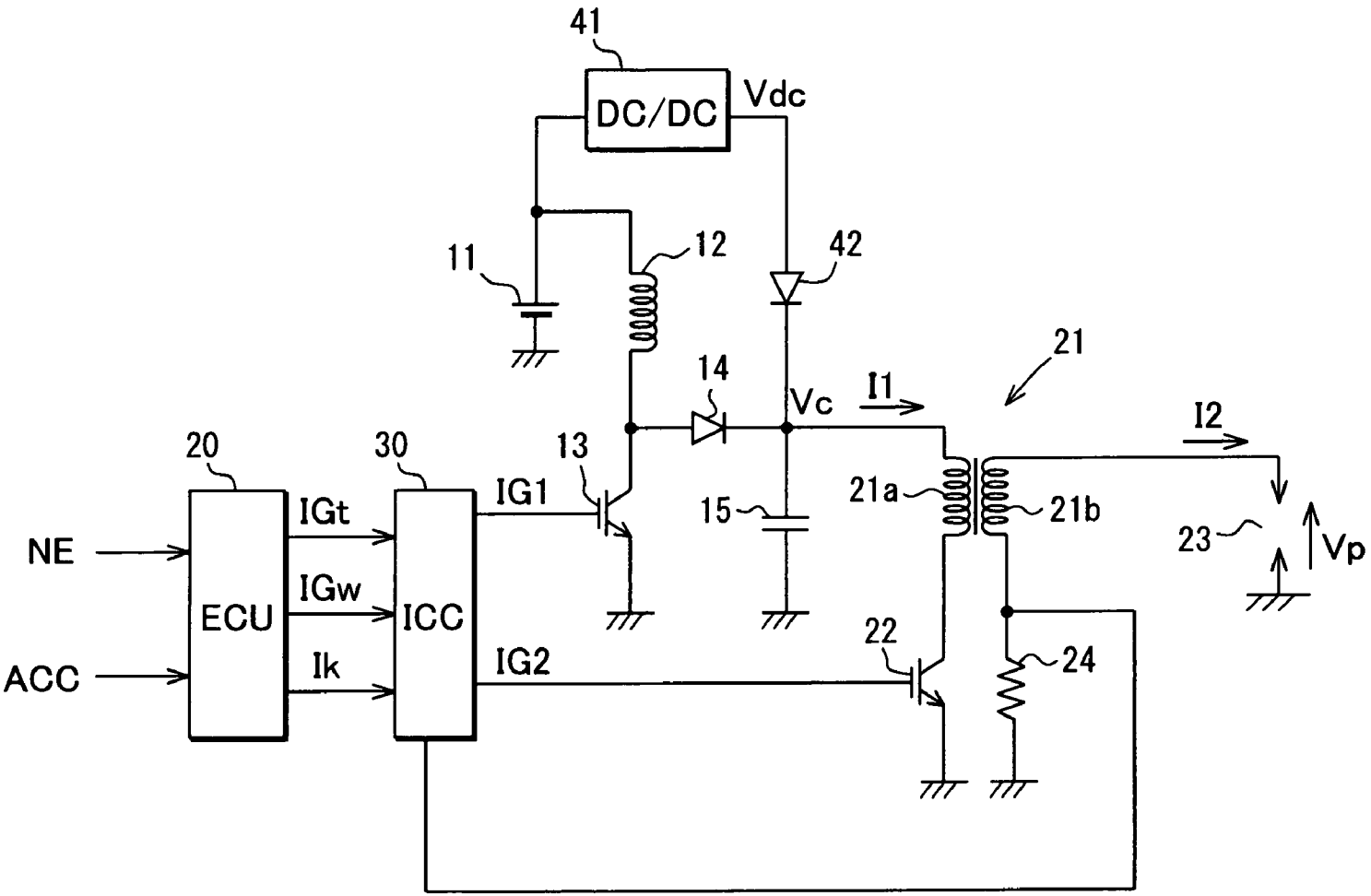
FIG. 7 is a block diagram of a multiple discharge ignition control apparatus according to a second embodiment of the invention.

As illustrated in FIG. 7, the battery 11 is connected with a DC/DC converter 41 with an output voltage of Vdc (several tens to a hundred of volts or so). At the same time, the DC/DC converter 41 is connected in series with the primary coil 21*a* through a diode 42 for reverse-flow prevention. This DC/DC converter 41 may be a conventional booster circuit constructed with an inductor, a transistor, a diode and a capacitor. With this construction, when IGBT 22 is turned on, the output voltage Vdc of the DC/DC converter 41 is applied to the primary coil 21*a*, and electrical energy is supplied from the DC/DC converter 41.

Figure 8:
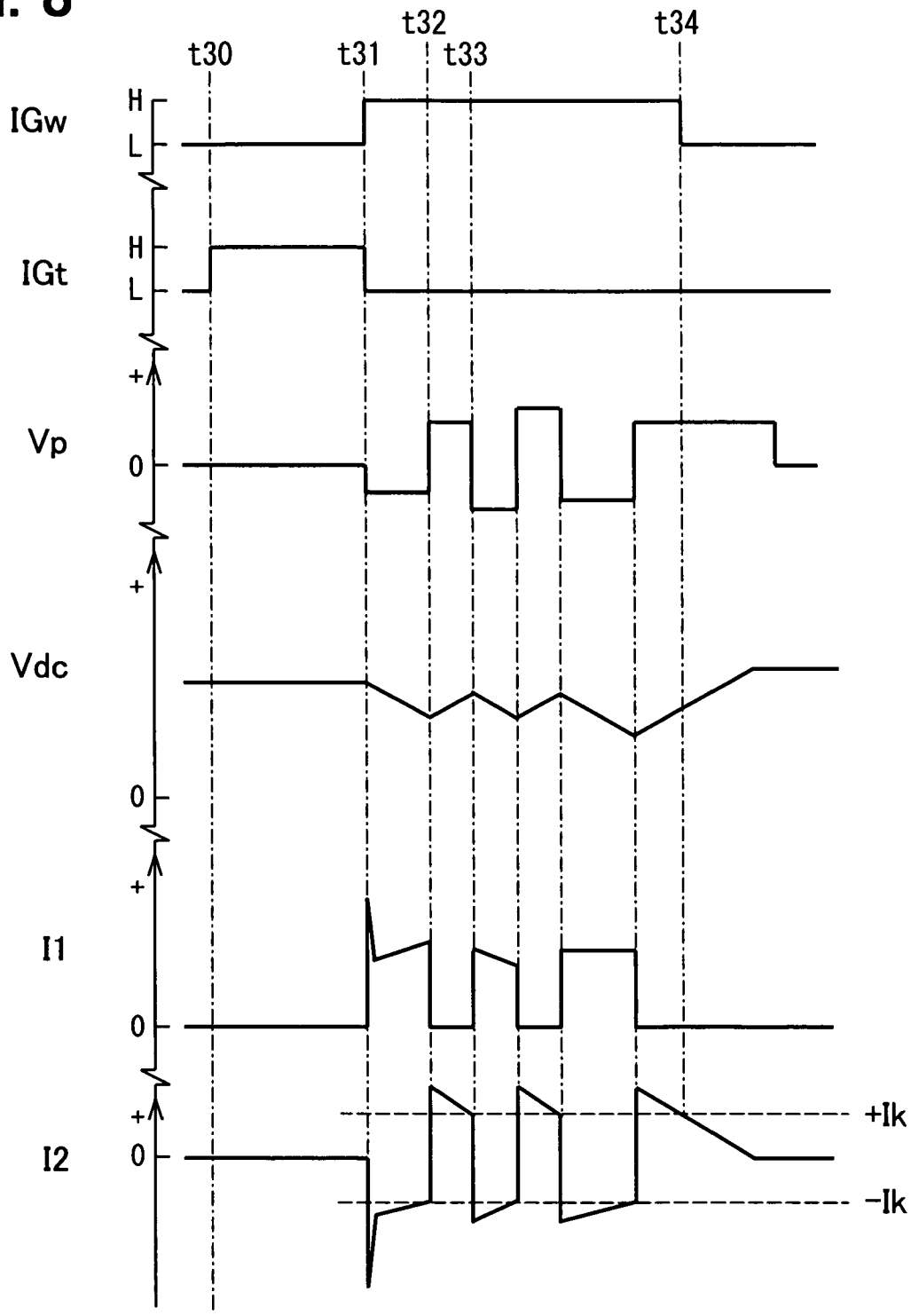
FIG. 8 is a signal diagram illustrating igniting operation in the second embodiment.

In the example illustrated in FIG. 8, initial ignition discharge is effected at time t31 as an ignition time, and ignition discharge is repeatedly effected during the period from time t31 to time t34 as a multiple discharge period.

First, during the period from time t30 to time T31 before the ignition time comes, IGBT 13 is turned on and the energy storage coil 12 is charged. When the IGBT 13 is turned off and the IGBT 22 is turned on at time t31 as the ignition time, the primary coil 21*a* is supplied with electrical energy from the DC/DC converter 41 as well as from the energy storage coil 12 and a capacitor 15. Thus, the plug voltage Vp of 2 kV or higher is applied to the spark plug 23, and ignition discharge occurs and the secondary current I2 of 50 mA or higher is supplied. At this time, the output voltage Vdc of the DC/DC converter 41 is gradually lowered in conjunction with the supply of electrical energy to the ignition coil 21.

Thereafter, the secondary current I2 is gradually lowered. When it reaches the negative discharge holding current −Ik at time t32, the IGBTs 13, 22 are switched between ON and OFF. Thus, ignition discharge is caused to occur at the spark plug 23 by the supply of electrical energy associated with the discharging of the ignition coil 21. At this time, a capacitor (not shown) in the DC/DC converter 41 is charged, and the output voltage Vdc of the converter is restored. Then, the secondary current I2 is lowered. When the secondary current I2 reaches the positive discharge holding current +Ik at time t33, the IGBTs 13, 22 are switched between ON and OFF. As a result, the ignition coil 21 is supplied with electrical energy again from the energy storage coil 12 and the DC/DC converter 41, and ignition discharge occurs at the spark plug 23.

Thereafter, the IGBTs 13, 22 are switched between ON and OFF and ignition discharge repeatedly occurs at the spark plug 23 each time the secondary current I2 reaches the positive or negative discharge holding current +Ik, −Ik. This is done until the multiple discharge period signal IGw is lowered to the L level at time t34. After time t34, the capacitor in the DC/DC converter 41 is charged, and the output voltage Vdc of the converter is restored to its original voltage.

According to the second embodiment, electrical energy is supplied from the DC/DC converter 41. Therefore, even when the flow velocity v of gas in proximity to the spark plug 23 is increased, the secondary current I2 can be kept at the discharge holding current Ik or higher.

Third Embodiment

Figure 9A:
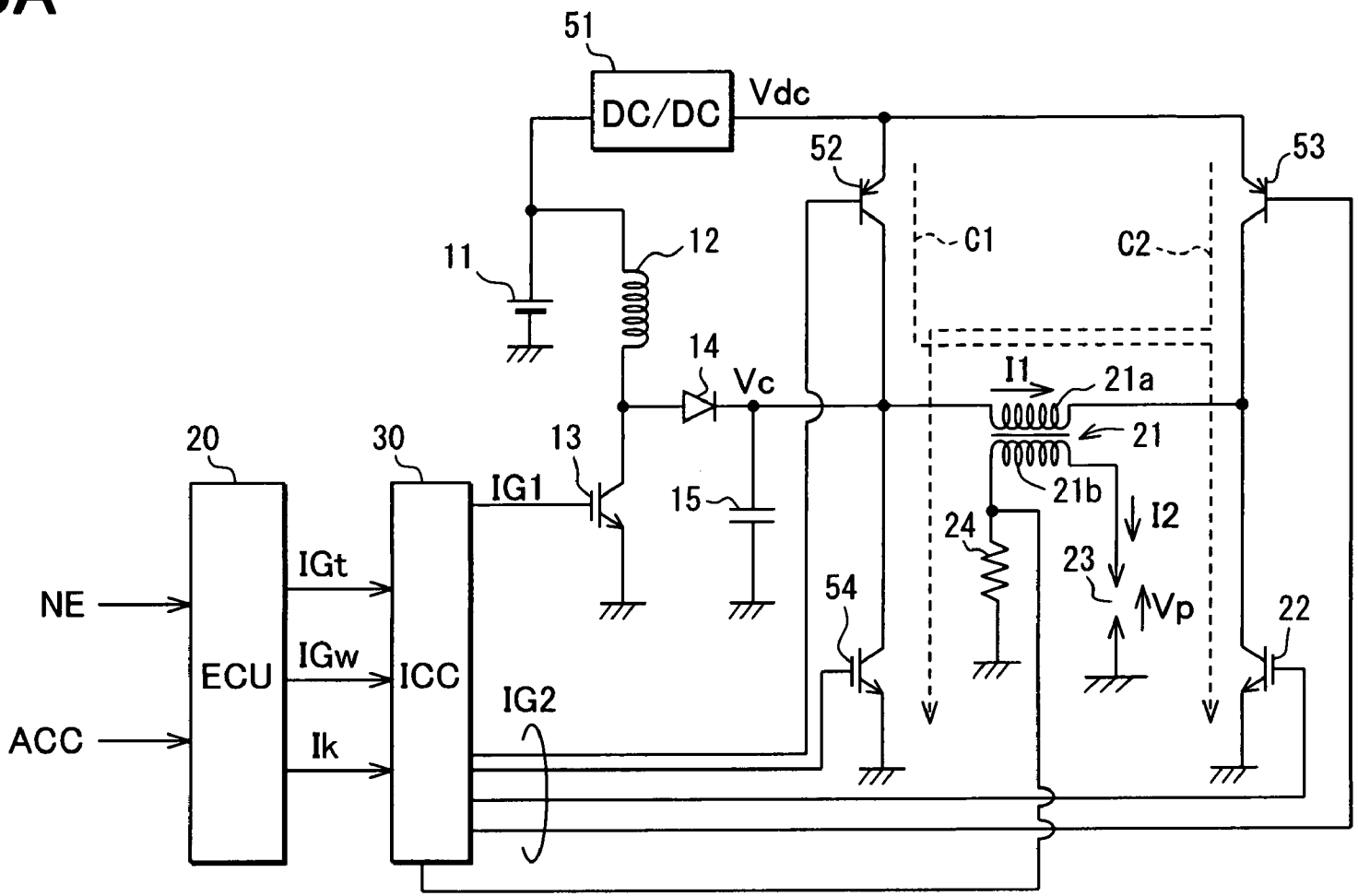
FIG. 9A is a block diagram illustrating a multiple discharge ignition control apparatus according to a third embodiment of the invention.

In a third embodiment shown in FIG. 9A, a DC/DC converter 51 is provided as a power supply means for boosting and outputting battery voltage. Further, an H-bridge circuit is constructed with transistors 52, 53 and IGBTs 22, 54 to supply a current from the DC/DC converter 51 to the primary coil 21*a* of the ignition coil 21 both in the forward direction and in the reverse direction. By supplying the current through the primary coil 21*a* both in the forward direction and in the reverse direction by this H-bridge circuit, electrical energy required for ignition discharge is supplied.

Specifically, the battery 11 is connected with the DC/DC converter 51 with the output voltage Vdc (several tens to a hundred of volts or so). The primary coil 21*a* is connected to the DC/DC converter 51 through either transistor 52 or 53 and is grounded through either IGBT 22 or 54. With this construction, when the transistor 52 and the IGBT 22 are turned on with the transistor 53 and the IGBT 54 being turned off, a current flows from the DC/DC converter 51 by way of a path C1 and a positive primary current I1 is supplied. When the transistor 53 and the IGBT 54 are turned on with the transistor 52 and the IGBT 22 being turned off, a current flows from the DC/DC converter 51 by way of a path C2, and a negative primary current I2 is supplied.

Figure 9B:
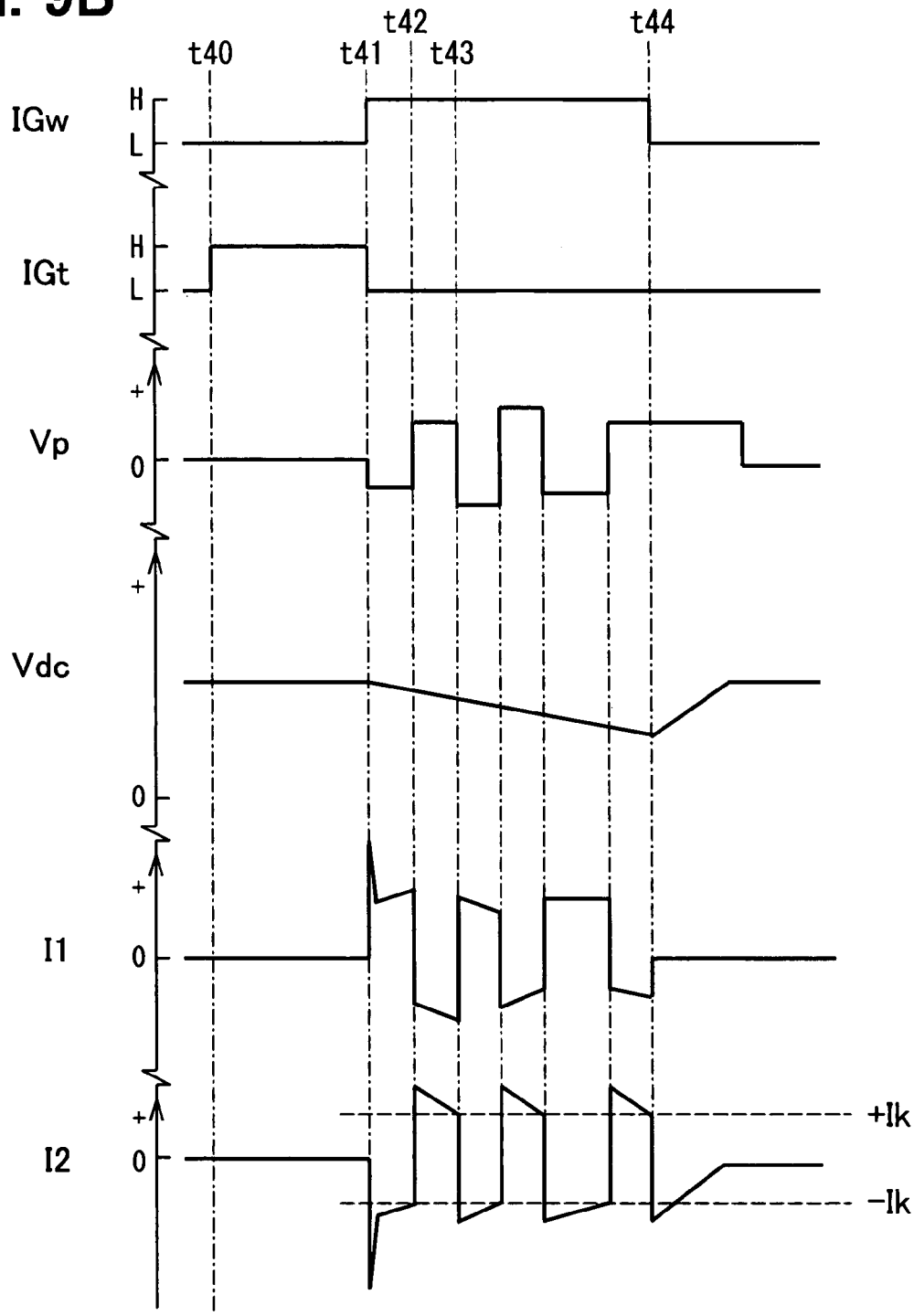
FIG. 9B is a signal diagram illustrating igniting operation in the third embodiment.

As illustrated in FIG. 9B, initial ignition discharge is effected at time t41 as an ignition time, and ignition discharge is repeatedly effected during the period from time t41 to time t44 as the multiple discharge period.

First, during the period from time t40 to time t41 before the ignition time comes, IGBT 13 is turned on and the energy storage coil 12 is charged. At time t41 as the ignition time, the IGBT 13 is turned off and the transistor 52 and the IGBT 22 are turned on. Thus, electrical energy is supplied to the primary coil 21*a* from the DC/DC converter 51 as well as from the energy storage coil 12 and the capacitor 15. At this time, a current flows from the DC/DC converter 51 by way of the path C1, and the positive primary current I1 is supplied. Thus, a plug voltage Vp of 2 kV or higher is applied to the spark plug 23, and ignition discharge occurs and the secondary current I2 of 50 mA or higher is supplied.

When the secondary current I2 is thereafter gradually lowered and reaches the negative discharge holding current −Ik at time t42, each switch device is switched between ON and OFF. Thus, the current flows from the DC/DC converter 51 by way of the path C2, and the negative primary current I1 is supplied. As a result, ignition discharge occurs at the spark plug 23 in conjunction with the discharging of the ignition coil 21. Thereafter, the secondary current I2 is reduced. When the secondary current I2 reaches the positive discharge holding current +Ik at time t43, each switch device is switched between ON and OFF. Thus, electrical energy is supplied from the energy storage coil 12 and the DC/DC converter 51, and ignition discharge occurs at the spark plug 23.

Thereafter, each switch device is switched between ON and OFF and ignition discharge repeatedly occurs at the spark plug 23 each time the secondary current I2 reaches the positive or negative discharge holding current +Ik, −Ik. This is done until the multiple discharge period signal IGw is lowered to the L level at time t44. At this time, the output voltage Vdc of the DC/DC converter 51 is gradually lowered in conjunction with the supply of electrical energy to the ignition coil 21. After time t44, the capacitor in the DC/DC converter 51 is charged and the output voltage Vdc is restored to its original voltage.

Thus, electrical energy is supplied from the DC/DC converter 51. Therefore, even when the flow velocity v of gas in proximity to the spark plug 23 is increased, the secondary current I2 can be kept at the discharge holding current Ik or higher. In this embodiment, the H-bridge circuit (22, 52, 53, 54) is constructed and the primary current I1 is supplied through the primary coil 21*a* both in the forward direction and in the reverse direction. Thus, the peak value of the primary current I1 can be reduced to half as compared with cases where the ignition coil 21 is charged and discharged by passing the primary current I1 through the primary coil 21*a* only in one direction. For this reason, heating from the ignition coil 21 can be suppressed.

Fourth Embodiment

Figure 10A:
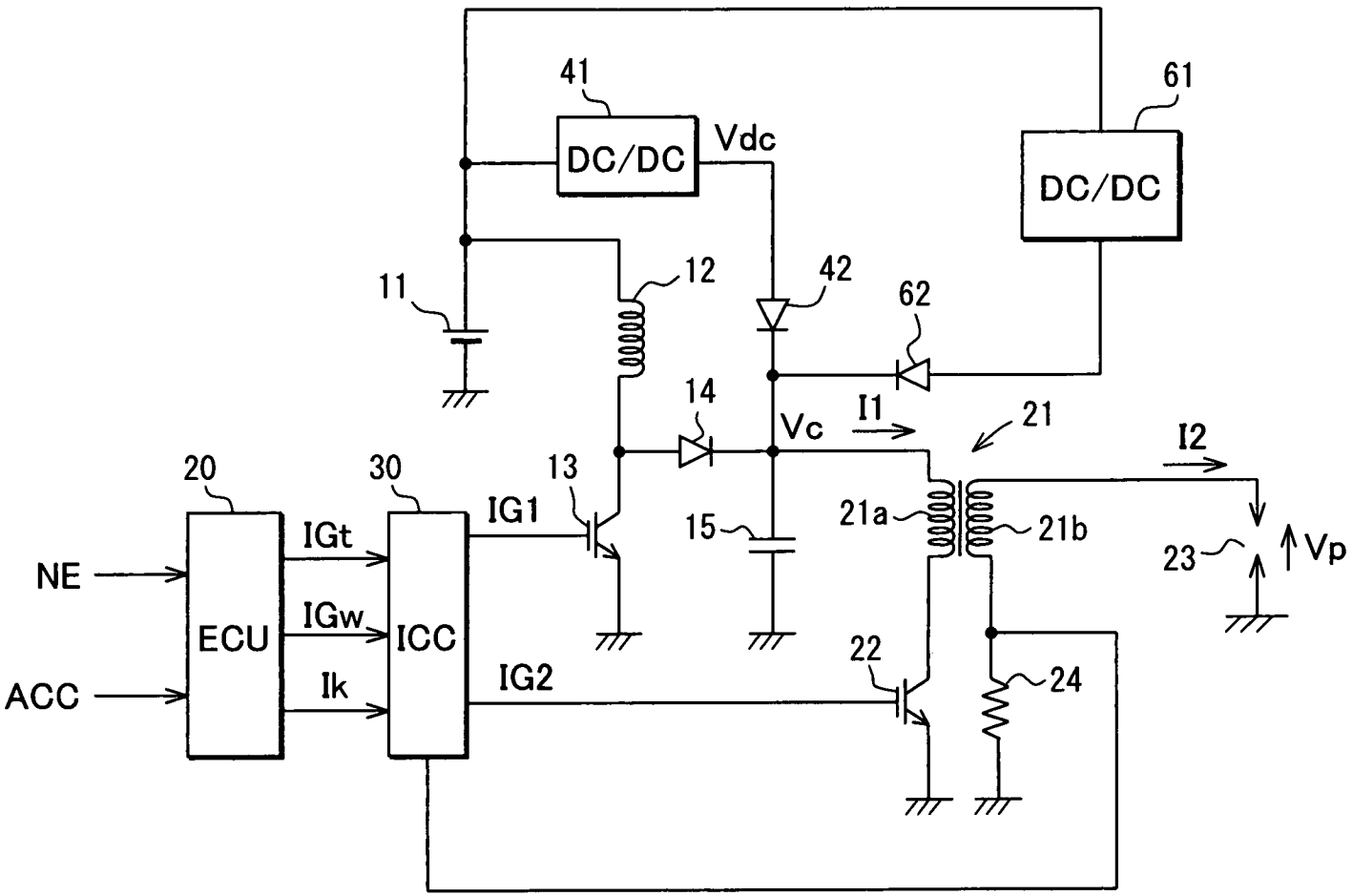
FIG. 10A is a block diagram illustrating a multiple discharge ignition control apparatus according to a fourth embodiment of the invention.

A fourth embodiment is provided for ultra-lean burn engines, in which the flow velocity is high and ignition discharge is less prone to occur. When each switch device is switched to effect ignition discharge, a plug voltage of 10 to 20 kV or so is required. Consequently, as shown in FIG. 10A, the fourth embodiment is provided with a DC/DC converter 61 for re-ignition whose output voltage is several hundred volts or so, in addition to the DC/DC converter 41 connected to the primary coil 21*a* of the ignition coil 21 in the second embodiment. In multiple discharge, a capacitor for capacitive discharge is occasionally charged by the DC/DC converter for re-ignition. When switch means are switched, ignition discharge is caused to occur by the supply of electrical energy from the capacitor for capacitive discharge.

Specifically, the battery 11 is connected with the DC/DC converter 61 for re-ignition whose output voltage is several hundred volts or so. At the same time, the DC/DC converter 61 for re-ignition is connected in series with the primary coil 21*a* through a diode 62 for reverse-flow prevention.

In this embodiment, the ignition control circuit 30 includes voltage detection circuit (not shown), for detecting the charging voltage of the capacitor 15. When ignition discharge is being effected at the spark plug 23 by the discharging of the ignition coil 21, the ignition control circuit 30 performs the following operation: when the secondary current I2 is equal to or lower than the discharge holding current Ik and the charging voltage of the capacitor 15 detected by the voltage detector becomes equal to or higher than a level (200V or so) required for re-ignition, the ignition control circuit 30 switches IGBTs 13, 22 between ON and OFF.

Figure 10B:
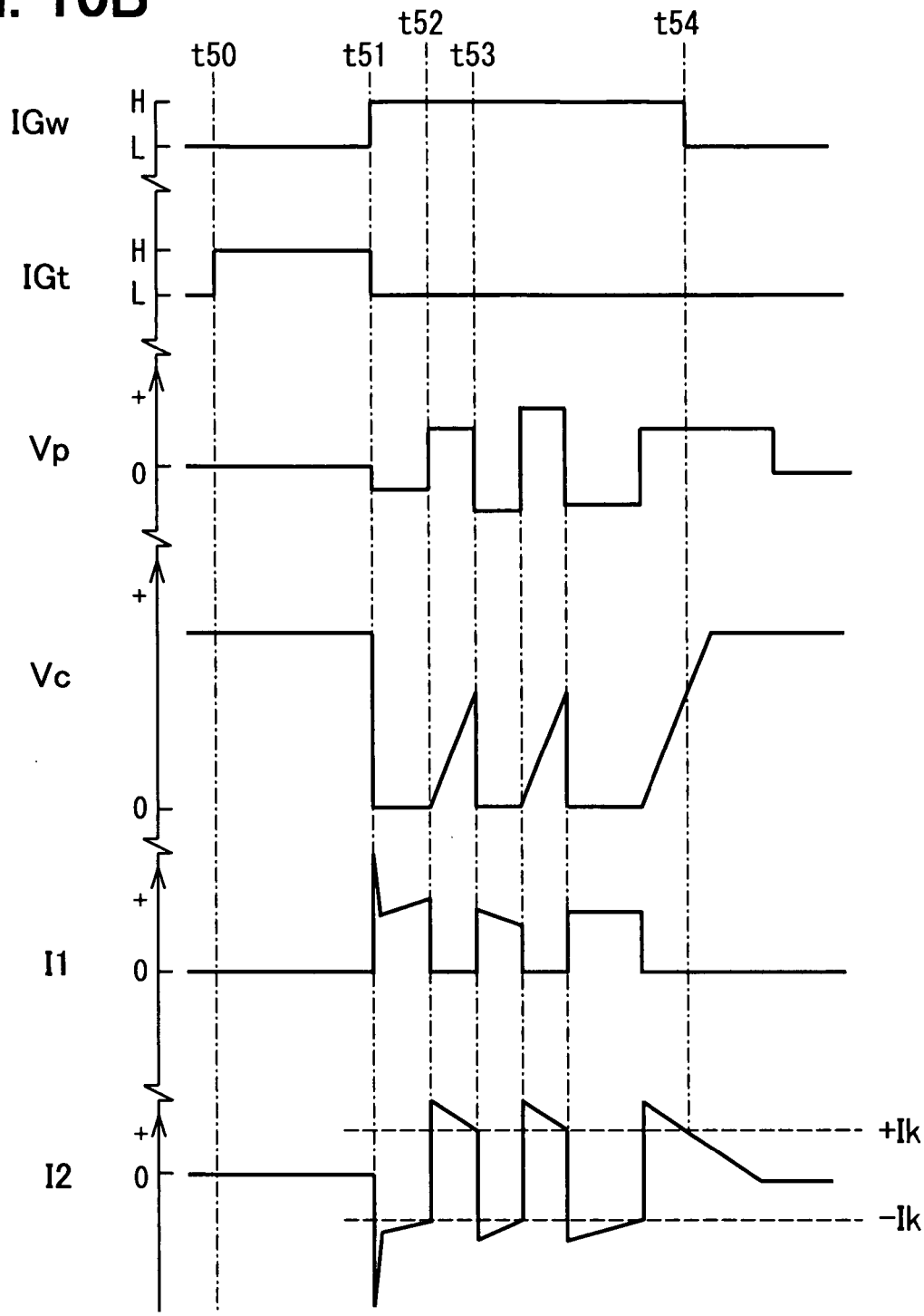
FIG. 10B is a signal diagram illustrating igniting operation in the fourth embodiment.

As illustrated in FIG. 10B, initial ignition discharge is effected at time t51 as the ignition time, and ignition discharge is repeatedly effected during the period from time t51 to time t54 as the multiple discharge period.

First, during the period from time t50 to time t51 before the ignition time comes, the IGBT 13 is turned on and the energy storage coil 12 is charged. When the IGBT 13 is turned off and the IGBT 22 is turned on at time t51 as the ignition time, the primary coil 21*a* is supplied with electrical energy from the DC/DC converter 41 as well as from the energy storage coil 12 and the capacitor 15. Thus, the plug voltage Vp of 10 kV or higher is applied to the spark plug 23, and ignition discharge occurs and the primary current I1 is supplied and the ignition coil 21 is charged.

When the secondary current I2 is gradually lowered and reaches the negative discharge holding current −Ik at time t52, the IGBTs 13, 22 are switched between ON and OFF. Thus, the plug voltage Vp of 10 kV or higher is applied to the spark plug 23 in conjunction with the discharging of the sufficiently charged ignition coil 21, and the spark plug 23 is re-ignited and ignition discharge occurs. Also, at this time, the capacitor 15 is charged by the DC/DC converter 61 for re-ignition. When the secondary current I2 is thereafter reduced and reaches the positive discharge holding current +Ik, the IGBTs 13, 22 are switched between ON and OFF. Electrical energy is supplied again from the energy storage coil 12 and the capacitor 15 recharged by the DC/DC converter 61 for re-ignition. Thus, the spark plug 23 is re-ignited and ignition discharge is effected.

Thereafter, the IGBTs 13, 22 are switched between ON and OFF and ignition discharge repeatedly occurs at the spark plug 23 each time the secondary current I2 reaches the positive or negative discharge holding current +Ik, −Ik. This is done until the multiple discharge period signal IGw is lowered to the L level at time t54.

According to the fourth embodiment, the DC/DC converter 61 for re-ignition is provided in parallel with the DC/DC converter 41. Thus, in multiple discharge, the capacitor 15 is charged and electrical energy is supplied from the capacitor 15 each time. For this reason, even when the flow velocity v of gas in proximity to the spark plug 23 is increased, ignition discharge can be effected without fail.

It is noted that the DC/DC converter 61 for re-ignition may be provided in the third embodiment in parallel with the DC/DC converter 51 so that the multiple discharge is effected. Even with this construction, the capacitor 15 can be charged and discharged, and ignition discharge can be effected without fail.

The above first to fourth embodiments are so constructed that initial ignition discharge is effected by a capacitive discharge ignition circuit (CDI circuit) including the capacitor 15 for capacitive discharge. However, the initial ignition discharge may be attained by the DC/DC converter 61 as long as the DC/DC converter 61 includes a capacitor for capacitive discharge.

Fifth Embodiment

Figure 11:
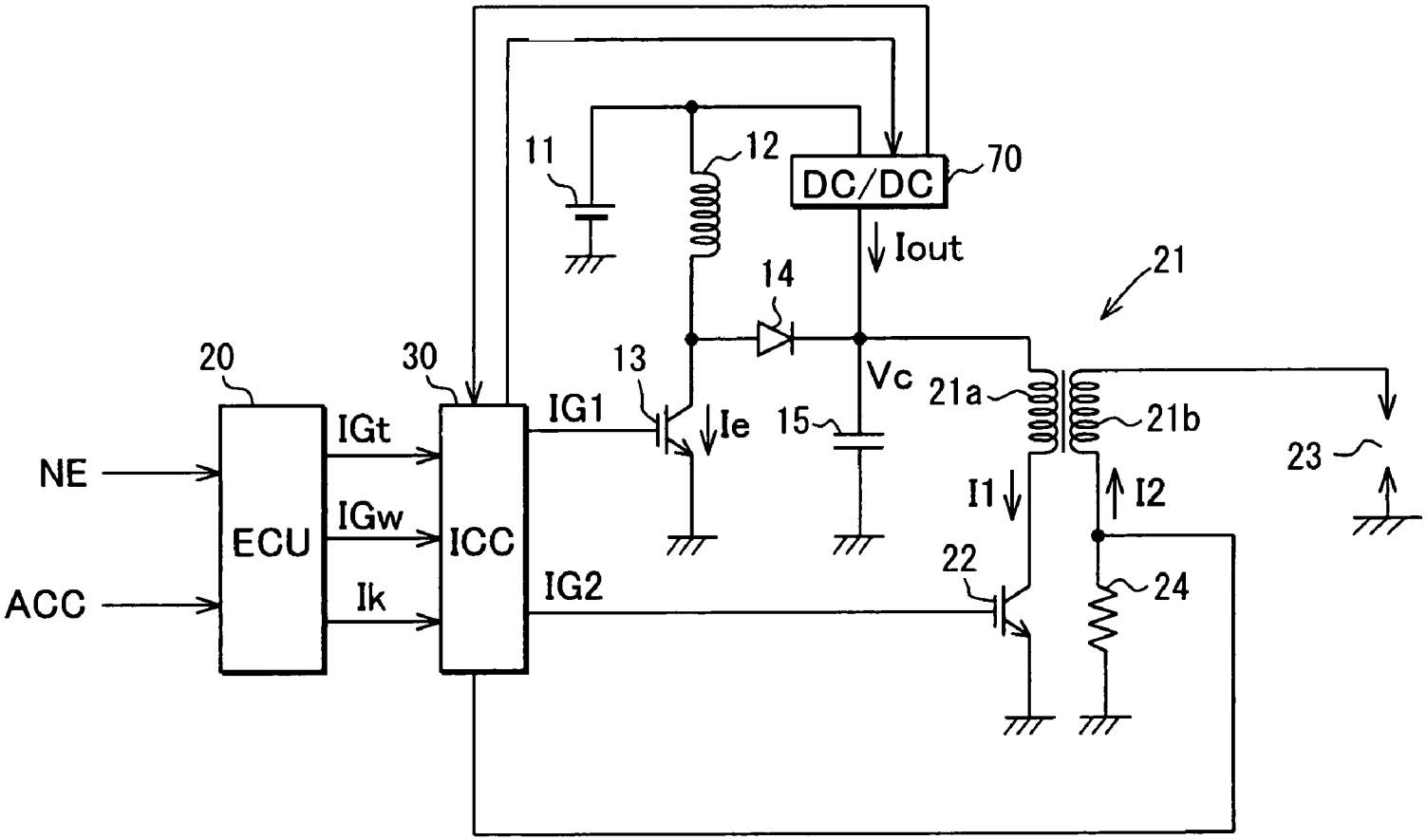
FIG. 11 is a block diagram illustrating a multiple discharge ignition control apparatus according to a fifth embodiment of the invention.

In a fifth embodiment, which is an improvement of the first to the fourth embodiments, as illustrated in FIG. 11, the battery 11 as a direct-current power source is connected with a series circuit of the energy storage coil 12 and the IGBT 13, and the energy storage coil 12 is connected in parallel with a DC/DC converter (booster circuit) 70. When the IGBT 13 is turned on, the energy storage coil 12 is energized. When the energy storage coil 12 is energized, electrical energy is stored there. The DC/DC converter 70 boosts a battery voltage (power supply voltage) to, for example, several tens to a hundred of volts or so by repeatedly turning on and off multiple boosting elements (boosting coils).

Between the energy storage coil 12 and the IGBT 13, a capacitor 15 is connected through the diode 14 for capacitive discharge. The capacitor 15 is also connected with the DC/DC converter 70. In this case, the capacitor 15 is charged with electrical energy stored in the energy storage coil 12 and energy (output current) supplied from the DC/DC converter 70.

The ignition coil 21 is constructed with the primary coil 21*a* and the secondary coil 21*b*, and is provided for each cylinder of an engine. One end of the primary coil 21*a* is connected with the intermediate point between the DC/DC converter 70 and the capacitor 15, and the other end is connected with the IGBT 22. When this IGBT 22 is turned on/off, electrical energy is intermittently supplied from the energy storage coil 12, DC/DC converter 70, and the capacitor 15 to the primary coil 21*a*, and the primary current I1 is generated in the primary coil 21*a*. One end of the secondary coil 21*b* is connected with the spark plug 23, and the other end is connected with the resistor 24 for current detection. When the primary coil 21*a* is energized, the secondary current I2 is supplied through the secondary coil 21*b* in conjunction with this energization. Ignition discharge is caused to occur at the spark plug 23 by supply of discharge energy from the ignition coil 21 (application of high voltage). In this example, the charging voltage of the capacitor 15 is Vc; the energization current supplied through the IGBT 13 is Ie; the output current of the DC/DC converter 70 is Iout; the primary current supplied through the primary coil 21*a* is I1 (the direction in which a current flows from a power supply system such as the battery 11 to the primary coil 21*a* is taken as positive); and the secondary current supplied through the secondary coil 21*b* is I2 (the direction in which a current flows from the secondary coil 21*b* to the spark plug 23 is taken as positive).

The ignition coil 21 and the IGBT 22 are provided for each cylinder of the engine. Meanwhile, the power supply system circuit constructed with the energy storage coil 12, DC/DC converter 70, capacitor 15, and the like is common to the each cylinder, and only one power supply system circuit is provided.

As is known, the ECU 20 is includes a microcomputer constructed with a CPU, a RAM, a ROM and the like. It executes various control programs stored in the ROM, and thereby controls the various states of engine operation. In ignition timing control, the ECU 20 acquires operation state information, such as engine rotational speed and an amount of accelerator operation, indicating the state of engine operation, and computes optimum ignition timing based on that operation state information. It generates an ignition signal IGt according to that ignition timing and outputs it to the ignition control circuit 30. To make combustion condition desirable, multiple discharge control is carried out and ignition discharge is effected at the spark plug 23 more than once in one combustion stroke. For this purpose, the ECU 20 computes the multiple discharge period based on the operation state information. Further, it generates the multiple discharge period signal IGw that defines this multiple discharge period and outputs it to the ignition control circuit 30.

Based on the ignition signal IGt and multiple discharge period signal IGw inputted from the ECU 20, the ignition control circuit 30 outputs driving signals IG1, IG2 for respectively turning on/off the IGBTs 13 and 22. Specifically, the ignition control circuit 30 outputs driving signals IG1, IG2 according to the ignition signal IGt to turn on/off the IGBTs 13, 22 and effects ignition discharge at the ignition time. Thereafter, it repeatedly turns on/off the IGBTs 13, 22 so that one of them is ON and the other is OFF during the multiple discharge period according to the multiple discharge period signal IGw, and thereby repeatedly effects ignition discharge.

For the purpose of improving the combustion in the engine and other like purposes, an airflow (swirl flow, tumble flow, etc.) is generated in an engine combustion chamber (cylinder). In cases where the in-cylinder airflow is generated as described above, the flow velocity of gas in proximity to the spark plug 23 is increased. This may weaken ignition discharge and cause ignition discharge to vanish in some cases. To cope with this, this embodiment takes the following measure to suppress vanishing of ignition discharge and the like in multiple discharge: the secondary current I2 is occasionally monitored, and the IGBTs 13, 22 are controlled and turned on/off so that the secondary current I2 (absolute value) does not fall below the "discharge holding current Ik."

It is desirable that the discharge holding current Ik should be set according to the in-cylinder gas flow velocity on a moment-by-moment basis. Specifically, it is set based on engine operation information (engine rotational speed, etc.) in correlation with in-cylinder gas flow velocity. It is assumed that the in-cylinder gas flow velocity increases with increase in the engine rotational speed, and increase in the in-cylinder gas flow velocity can cause the possibility of ignition discharge vanishing to arise. Therefore, the higher the engine rotational speed is, the more the discharge holding current Ik is increased. In addition, the discharge holding current Ik may be set based on the degree of leanness in the air-fuel ratio, which is a control parameter for swirl flows, tumble flows, and the like. In this case, the higher the degree of leanness in the air-fuel ratio is, the more the discharge holding current Ik is increased.

Figure 12:
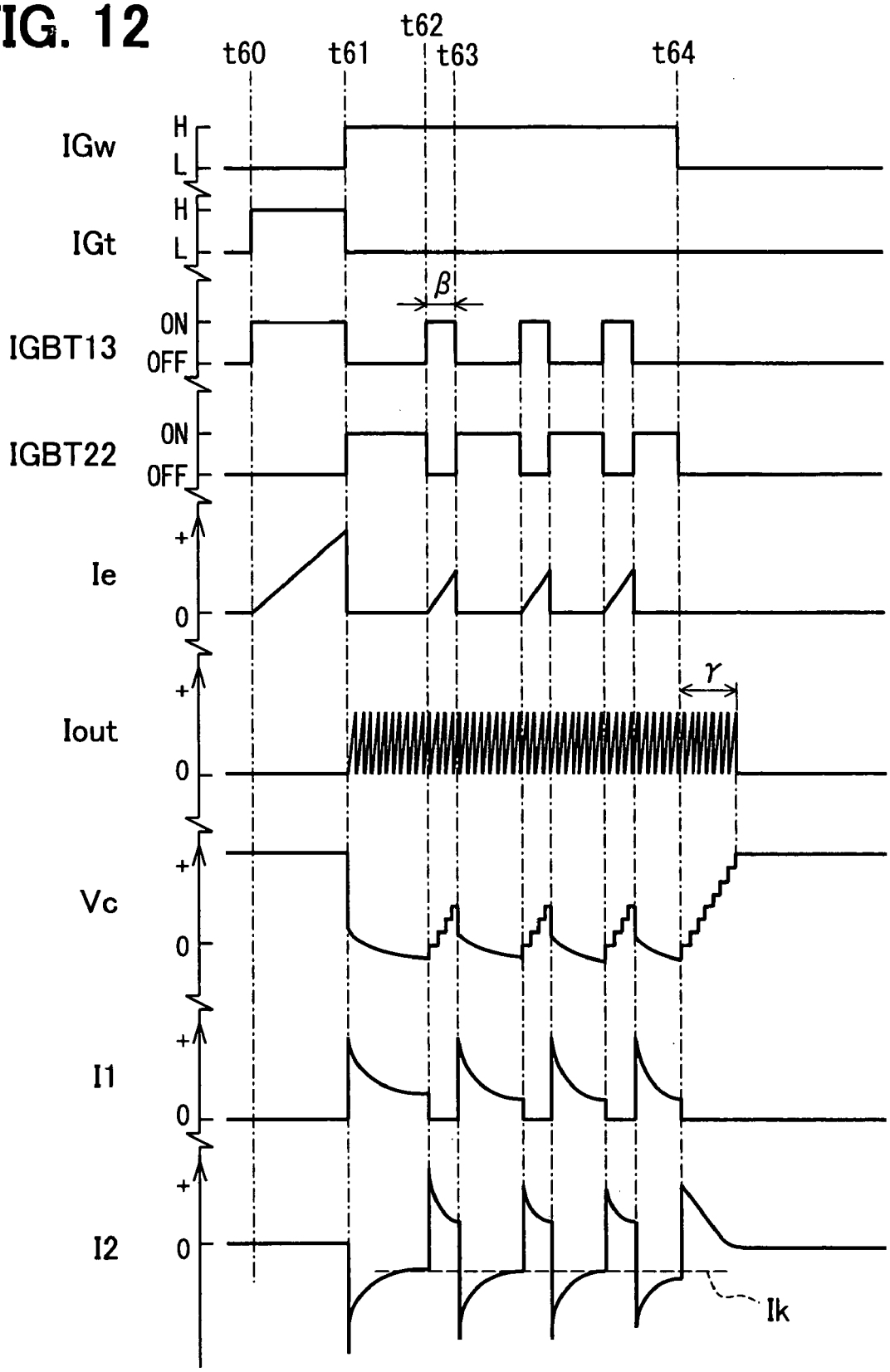
FIG. 12 a signal diagram illustrating ignition operation in the fifth embodiment.

As illustrated in FIG. 12, the initial ignition discharge is effected at time t61 as an ignition time, and discharge is repeatedly effected during the period from time t61 to time t64 as the multiple discharge period. In this example, the conducting period of the primary coil 21*a* (the on period of the IGBT 22) is controlled based on the secondary current I2, and the charging periods of the energy storage coil 12 and the capacitor 15 (the on period of the IGBT 13) are so controlled that they are certain periods of time.

When the ignition signal IGt is raised to the H level at time t60 before the ignition time t61 comes, the IGBT 13 is turned on in response thereto. The energization current Ie is supplied through the IGBT 13 and the energy storage coil 12 is charged. When the ignition signal IGt is lowered to the L level at time t61 as the ignition time, the IGBT 13 is turned off and further the IGBT 22 is turned on. Thus, the primary coil 21*a* is simultaneously supplied with electrical energy from the energy storage coil 12, DC/DC converter 70 and capacitor 15, and high voltage is induced in the secondary coil 21*b*. In conjunction with this, ignition discharge occurs at the spark plug 23, and the secondary current I2 is supplied in the negative direction.

At time t61, the multiple discharge period signal IGw is raised to the H level. During the multiple discharge period for which the multiple discharge period signal IGw is at the H level, battery voltage boosting operation is performed at the DC/DC converter 70. As a result, the output current Iout of several tens of amperes or so flows from the DC/DC converter 70, and it is supplied to the primary coil 21*a* and the capacitor 15. During the period for which the IGBT 22 is ON, the primary current I1 is caused to flow by the output current Iout supplied from the DC/DC converter 70. As a result, ignition discharge continuously occurs at the spark plug 23. The electrical energy of the secondary current I2 is consumed by the ignition discharge at the spark plug 23, and the secondary current I2 is gradually reduced as illustrated.

After time t61, the IGBTs 13, 22 are alternately turned on/off, and ignition discharge is repeatedly caused to occur at the spark plug 23. At time t62 when the secondary current I2 (absolute value) is lowered to the discharge holding current Ik in this case, the IGBT 13 is turned on and further the IGBT 22 is turned off. Thus, during the period from time t62 to time t63, the energy storage coil 12 is recharged, and the secondary current I2 due to counter electromotive force is supplied through the secondary coil 21*b*. In addition, during the period from time t62 to time t63, the capacitor 15 is charged, as illustrated, by the output current Iout supplied from the booster circuit 14.

At time t63 when a predetermined time (period of time) β has supplied after time t62, the IGBT 13 is turned off and further the IGBT 22 is turned on. As a result, the primary coil 21*a* is supplied with electrical energy again from the energy storage coil 12, DC/DC converter 70 and capacitor 15, and ignition discharge occurs at the spark plug 23.

Thereafter, the IGBTs 13, 22 are repeatedly switched between ON and OFF and ignition discharge repeatedly occurs at the spark plug 23 until the multiple discharge period signal IGw is lowered to the L level at time t64. Specifically, after the energization of the primary coil 21*a* is started (after the IGBT 22 is turned on), the energization of the primary coil 21*a* is terminated (the IGBT 22 is turned off) when the secondary current I2 (absolute value) is lowered to the discharge holding current Ik. Thereafter, the IGBT 13 is kept ON and the IGBT 22 is kept OFF only for the certain period of time γ.

When the multiple discharge period signal IGw is lowered to the L level at time t64, the boosting operation of the DC/DC converter 70 is continuously carried out only for a certain period of time γ. Thus, the capacitor 15 is charged to a predetermined voltage. That is, a capacitor charging period is provided after a multiple discharge period has supplied.

In the multiple discharge, energization of the primary coil 21*a* and charging of the capacitor 15 are carried out by the output current Iout (electrical energy) supplied from the DC/DC converter 70. If the output current Iout of the DC/DC converter 70 varies, the amount of energization of the primary coil 21*a* and the amount of charge of the capacitor 15 vary. As a result, excess or deficiency can be produced in energy in the primary coil 21*a*, and this may cause unstable spark discharge at the spark plug 23.

Figure 13A:
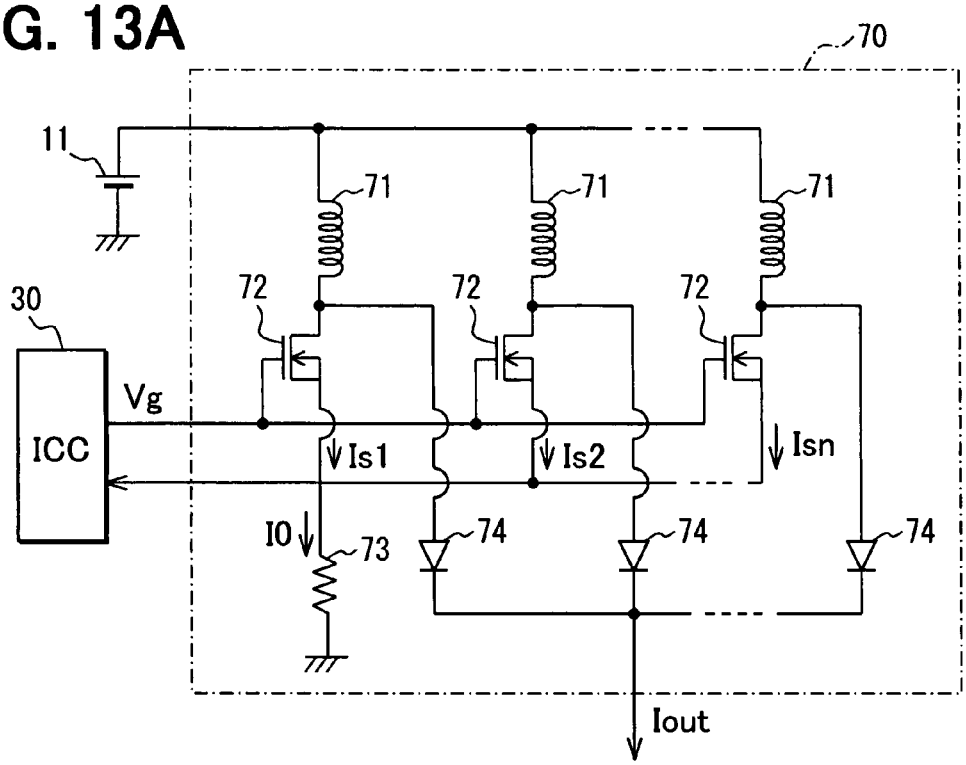
FIGS. 13A and 13B are circuit diagrams of booster circuits in the fifth embodiment and in a comparative example, respectively.
Figure 13B:
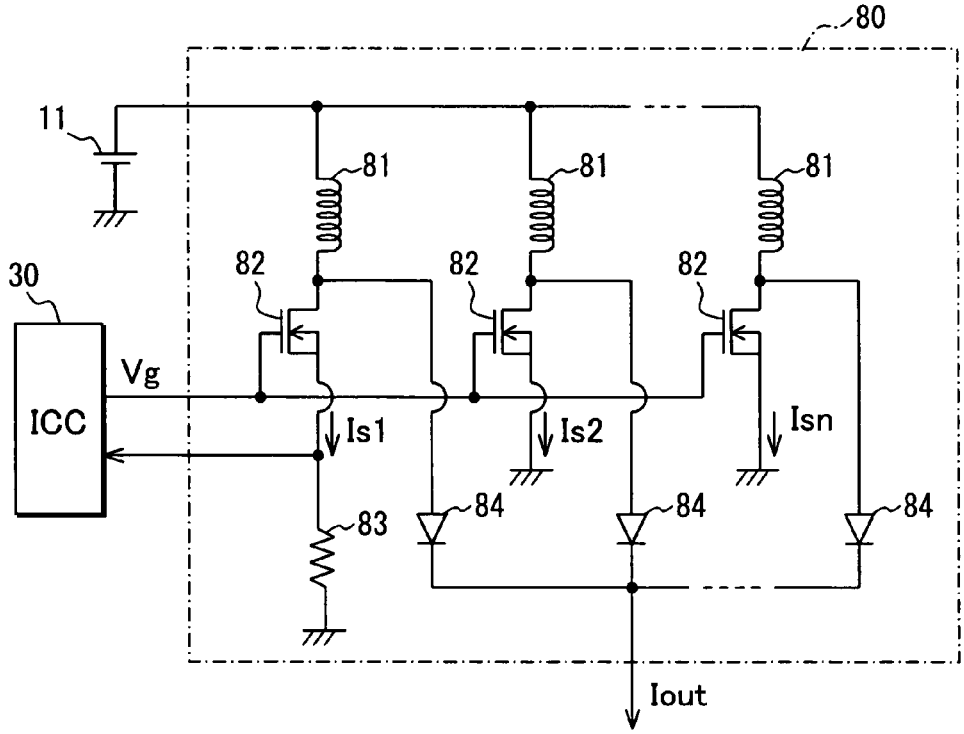

It is therefore preferred to construct the DC/DC converter 70 as shown in FIGS. 13A and 13B.

As illustrated in FIG. 13A, the DC/DC converter 70 includes multiple boosting coils 71 connected in parallel. One ends of these boosting coils 71 are connected with the battery 11. The other ends of the boosting coils 71 are respectively connected with the drain terminals of MOSFETs 72. The source terminal of each MOSFET 72 is connected to a resistor 73 for current detection. That is, the current paths of the multiple boosting coils 71 are integrated, and their integrated area is provided with the resistor 73.

The gate terminals of the MOSFETs 72 are integrated into one, and a gate voltage Vg is applied to each gate terminal. The gate voltage Vg is a boosting control signal outputted from the ignition control circuit 30. By H-level gate voltage Vg being outputted from the ignition control circuit 30, the multiple MOSFETs 72 are simultaneously turned on, and each boosting coil 71 is energized by the battery 11. When the MOSFETs 72 are turned on, energization currents Is1, Is2, . . . , Isn are supplied through the individual MOSFETs 72, and the total sum current I0 obtained by adding all the energization currents Is1 to Isn is detected by the resistor 73. The detection value of the total sum current I0 is outputted as a current detection signal to the ignition control circuit 30. Each time the current detection signal (total sum current I0) reaches a predetermined threshold value, the ignition control circuit 30 turns off the gate voltage Vg. When a predetermined time passes thereafter, the ignition control circuit 30 turns on the gate voltage Vg again. Thus, each MOSFET 72 is repeatedly turned on and off.

Between the boosting coils 71 and the drain terminals of the MOSFETs 72, there are connected diodes 74 for reverse-flow prevention. The output current Iout is supplied to the primary coil 21*a* and the capacitor 15 through these diodes 74.

As illustrated in FIG. 13B, a DC/DC converter 80 in a comparative example includes multiple boosting coils 81 and MOSFETs 82 connected with the respective boosting coils 81. The DC/DC converter 80 is identical with the DC/DC converter 70 in FIG. 13A in this regard. In the DC/DC converter 80, the MOSFETs 82 are simultaneously turned on and off by the ignition control circuit 30. The DC/DC converter 80 is also similar to the DC/DC converter 70 in FIG. 13A in that diodes 84 for reverse-flow prevention are connected between the boosting coils 81 and the drain terminals of the MOSFETs 82, and the primary coil 21*a* and the like are supplied with the output current Iout through these diodes 84.

The DC/DC converter 80 is however different from the DC/DC converter 70 in that a resistor 83 for current detection is connected with the source terminal of only one MOSFET 82. In this case, when the MOSFETs 82 are turned on, energization currents Is1, Is2, . . . , Isn are supplied through the individual MOSFETs 82, and only the energization current Is1 is detected by the resistor 83. The ignition control circuit 30 turns off the gate voltage Vg each time the current detection signal (energization current Is1) reaches a predetermined threshold value. When a predetermined time passes thereafter, it turns on the gate voltage Vg again. Thus, each MOSFET 82 is repeatedly turned on and off.

Figure 14A:
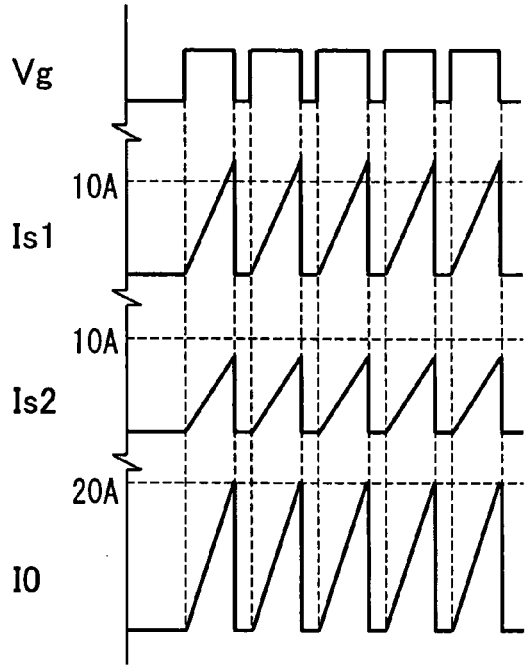
FIGS. 14A and 14B are signal diagrams illustrating operations of the booster circuits in the fifth embodiment and in the comparative example.
Figure 14B:
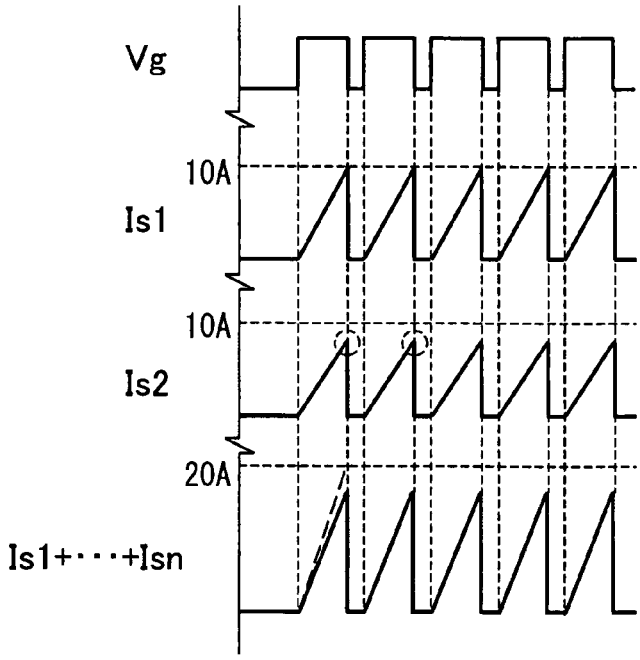

FIG. 14A is a signal diagram illustrating the operation of the DC/DC converter 70 of the fifth embodiment (FIG. 13A), and shows a case where only two boosting coils 71 are provided as an example for convenience of explanation. FIG. 14B is a signal diagram illustrating the operation of the DC/DC converter 80 of the comparative example (FIG. 13B), and shows a case where only two boosting coils 81 are provided as an example for convenience of explanation.

In the comparative example in FIG. 14B, the coil energization current Is1 is detected, and the gate voltage Vg is turned off each time the coil energization current Is1 reaches a predetermined threshold current (e.g., 10 A). That is, the turn-on/off of the MOSFETs 82 in all the systems is controlled based on a current detection value in one system. In this case, the multiple boosting coils 81 include variation in inductance due to an individual difference, change over time, or the like. This variation in inductance produces a difference in energization currents from coil to coil. Specifically, as shown in FIG. 14B, in some situation even when the coil energization current Is1 reaches the threshold current (10 A), the coil energization current Is2 does not reach the threshold current (10 A). As a result, the total sum current obtained by adding the currents supplied through the boosting coils 81 is lower than the output current value (e.g., 20 A) desired for the DC/DC converter 80, and ignition discharge can vanish midway through multiple discharge.

In other situations, although not shown, it may occur that, when the coil energization current Is1 reaches the threshold current (10 A), the coil energization current Is2 exceeds the threshold current (10 A). In this case, the supplied energy is too much, and the energy is wastefully consumed.

In the example illustrated in FIG. 14A, however, the total sum current I0 obtained by adding the currents supplied through the individual boosting coils 71 is detected. Therefore, even if inductance varies from boosting coil 71 to boosting coil 71, it will not occur that the output current Iout of the DC/DC converter 70 is lower than the required output current value (e.g., 20 A). In the multiple discharge, therefore, there is no possibility that ignition discharge vanishes partway. Further, the occurrence of the situation in which the output current Iout of the DC/DC converter 70 becomes excessive and energy is wastefully consumed is suppressed.

According to the fifth embodiment, the following advantages are provided.

The DC/DC converter 70 is provided with the multiple boosting coils 71, and is so constructed that the multiple boosting coils 71 are simultaneously turned on and off by the MOSFETs 72. For this reason, a sufficient quantity of output current Iout can be supplied in the DC/DC converter 70. Therefore, it is possible to supply high-level electrical energy to the primary coil 21*a* and the capacitor 15, and to effect stable spark discharge in ignition by the spark plug 23.

In the DC/DC converter 70, especially, the turn-on/off of the MOSFETs 72 is controlled based on the total sum current of the currents supplied through the multiple boosting coils 71. Therefore, even if there is variation in inductance from boosting coil 71 to boosting coil 71, excess or deficiency in supplied energy can be eliminated regardless of that. Because of the foregoing, it is possible to supply energy sufficient for multiple discharge to the primary side of the ignition coil 21 during multiple discharge. Further, it is possible to stabilize ignition discharge at the spark plug 23. As a result, the combustion condition in the engine can be made favorable.

The fifth embodiment is so constructed that the following is implemented: the resistor 73 for current detection is provided in an area where the current paths of the individual boosting coils 71 are integrated, and the total sum current of the DC/DC converter 70 is computed based on the result of current detection by the resistor 73. Therefore, the total sum current can be appropriately detected regardless of any variation from boosting coil 71 to boosting coil 71. Further, the detection circuit can be simplified as compared with cases where the energization current is individually detected with respect to each boosting coil 71.

The ignition control circuit 30 is so constructed that when it controls boosting in the DC/DC converter 70, the MOSFETs 72 are controlled and turned off each time the total sum current of the currents supplied through the multiple boosting coils 71 reaches the predetermined threshold value. Therefore, the amount of energy supplied from the DC/DC converter 70 can be appropriately controlled, and sufficient supplied energy can be constantly ensured.

The capacitor 15 is charged with power fed from the DC/DC converter 70 when the primary coil 21*a* is not energized; and when the primary coil 21*a* is energized, the capacitor 15 is discharged to the primary coil 21*a*. Therefore, when the primary coil 21*a* is energized, a large current can be supplied through the primary coil 21*a* by the energy for ignition stored in the capacitor 15. In conjunction with this, high secondary voltage having sufficient magnitude can be generated in the secondary coil 21*b*. Since the capacitor 15 is recharged each time the primary coil 21*a* is not energized, the energy for ignition in the capacitor 15 can be repeatedly used when multiple discharge is carried out.

Further, the power supply system is provided with the energy storage coil 12, and the energy storage coil 12 is repeatedly charged and discharged in multiple discharge. Therefore, energy supplied to the primary coil 21*a* can also be sufficiently ensured with this construction, which can be made to contribute to the stabilization of ignition discharge.

In the multiple discharge, the secondary current I2 supplied through the secondary coil 21*b* of the ignition coil 21 is detected, and the IGBTs 13, 22 are switched between ON and OFF each time the detection value (absolute value) reaches the discharge holding current Ik. Thus, even when the in-cylinder gas flow velocity is high, the occurrence of such a problem that ignition discharge vanishes midway through multiple discharge can be suppressed.

The discharge holding current Ik is variably set based on engine operation information in correlation with in-cylinder gas flow velocity. Therefore, even if the in-cylinder gas flow velocity is increased in correspondence with engine rotational speed or the like, the secondary current I2 required for ignition discharge can be favorably ensured.

The above embodiments may be modified in the following various ways.

In the embodiments, in the multiple discharge operation: after the energization of the primary coil 21*a* is started (after the IGBT 22 is turned on), the energization of the primary coil 21*a* is terminated (the IGBT 22 is turned off) when the secondary current I2 (absolute value) flowing in the negative direction is lowered to the discharge holding current Ik. Thereafter, the IGBT 13 is kept on and the IGBT 22 kept off only for a predetermined period of time. It is however possible, for example, to implement: in addition to the secondary current I2 flowing in the negative direction, the secondary current I2 flowing in the positive direction is monitored; and the turn-on/off of the IGBTs 13, 22 is controlled with the discharge holding current Ik taken as a threshold value with respect to both the positive secondary current I2 and the negative secondary current I2. Further, instead of controlling the turn-on/off of the IGBETs 13, 22 based on the secondary current I2, it is possible that the IGBTs 13, 22 are switched between ON and OFF each time a predetermined time has supplied.

Although the DC/DC converter 70 is provided with multiple boosting coils 71 as a boosting element group, multiple boosting transformers may be provided. In this case, the following is implemented: a boosting switching element (MOSFET) is connected with the primary side of each boosting transformer and its energization is turned on and off; and the total sum of currents supplied through the secondary side (total sum current) is supplied as the output current of the booster circuit to the primary coil and the like. Also, with this construction, it is made possible to suppress excess or deficiency in energy and to stabilize ignition discharge at the spark plug, by taking the following measure as in the above embodiments: in the booster circuit, the turn-on/off of the boosting switching elements (MOSFETs) is controlled based on the total sum current obtained by adding the currents supplied through the multiple boosting transformers.

Although the DC/DC converter 70 is provided with the diodes 74 for reverse-flow prevention between the boosting coils 71 and the drain terminals of the MOSFETs 72, an element other than diode, for example, MOSFET may be used for reverse-flow prevention.

Although the power supply system is so constructed that the energy storage coil 12 and the DC/DC converter 70 are connected in parallel with the battery 11, the energy storage coil 12 may be omitted.

What is claimed is:

1. A multiple discharge ignition control apparatus for internal combustion engines having an ignition coil with a primary coil and a secondary coil connected to a spark plug, the multiple discharge ignition control apparatus comprising:

an energy storage coil;

first switch means connected in series with the energy storage coil;

second switch means being connected in series with the energy storage coil and the primary coil;

the first switch means and the second switch means being alternately turned on and off to repeatedly charge and discharge the energy storage coil thereby to generate a secondary current in the secondary coil both in a forward direction and in a reverse direction by the charging and discharging to carry out multiple discharge in the spark plug;

current detection means for detecting the secondary current; and control means for switching the first switch means and the second switch means between ON and OFF each time the secondary current reaches a predetermined discharge holding current value in the multiple discharge.

2. The multiple discharge ignition control apparatus of claim 1, wherein the control means acquires information related to an in-cylinder flow velocity of air-fuel mixture gas in the internal combustion engine, and variably sets the discharge holding current value based on the information.

3. The multiple discharge ignition control apparatus of claim 2, wherein the information includes engine operating states.

4. The multiple discharge ignition control apparatus of claim 3, wherein the engine operating states include rotational speed of the internal combustion engine.

5. The multiple discharge ignition control apparatus of claim 3, wherein the engine operating states include a degree of leanness of an air-fuel ratio.

6. The multiple discharge ignition control apparatus of claim 1, further comprising:

power means connected in series with the primary coil and the second switch means to boost a voltage of a battery and supplies a boosted voltage to the primary coil separately from the energy storage coil.

7. The multiple discharge ignition control apparatus of claim 6, further comprising:

an H-bridge circuit that leads a current flow from the power means to the primary coil both in the forward direction and in the reverse direction, wherein the control means changes a direction in which the current supplied through the primary coil each time the secondary current detected by the current detection means reaches the discharge holding current value in the multiple discharge.

8. The multiple discharge ignition control apparatus of claim 6, further comprising:

capacitor discharge means connected in parallel with the power means and including a capacitor for capacitive discharge and charging means for charging the capacitor.

9. The multiple discharge ignition control apparatus of claim 2, wherein the control means increases the discharge holding current value with an increase in the in-cylinder flow velocity.

10. The multiple discharge ignition control apparatus of claim 6, wherein the power means includes two DC/DC converters connected in parallel with each other.

11. A multiple discharge ignition control apparatus for internal combustion engines having an ignition coil with a primary coil and a secondary coil connected to a spark plug, the multiple discharge ignition control apparatus comprising:

a booster circuit connected to the primary coil for boosting power supply voltage; and switching means repeatedly turned on and off to intermittently cause a current to flow from the booster circuit to the primary coil, so that a secondary current is repeatedly generated in the secondary coil to effect multiple discharge, wherein the booster circuit includes a plurality of boosting elements connected in parallel, boosting switching elements that respectively turn on and off energization of the plurality of boosting elements;

detection means for detecting a total sum of currents supplied through the plurality of boosting elements; and boosting control means for controlling turn-on/off of the boosting switching elements based on the total sum of currents detected by the detection means.

12. The multiple discharge ignition control apparatus of claim 11, wherein the energization of the plurality of boosting elements is simultaneously turned on and off during a period for which multiple discharge is carried out.

13. The multiple discharge ignition control apparatus of claim 11, wherein the detection means is located at a position where current paths of the plurality of boosting elements are integrated.

14. The multiple discharge ignition control apparatus of claim 11, wherein the boosting control means controls and turns off the boosting switching elements when the total sum of currents supplied through the plurality of boosting elements reaches a predetermined threshold value.

15. The multiple discharge ignition control apparatus of claim 11, further comprising:

a capacitor connected at an intermediate point between the booster circuit and the primary coil for storing energy for ignition, the capacitor being charged with power supplied from the booster circuit when the primary coil is not energized and discharged to the primary coil when the primary coil is energized.

16. The multiple discharge ignition control apparatus of claim 11, further comprising:

an energy storing device connected with a series circuit of an energy storage coil and a switching means for energy storage, wherein, in multiple discharge, the switching means for ignition and the switching means for energy storage are alternately turned on and off so that one of the switching means is ON and the other is OFF.

17. A multiple discharge ignition control method for internal combustion engines having an ignition coil with a primary coil and a secondary coil connected to a spark plug, the multiple discharge ignition control method comprising:

generating an ignition time signal at an ignition time;

supplying a primary current to the primary coil in response to the ignition time signal thereby to generate a secondary current in the secondary coil for starting ignition by the spark plug;

generating a multiple discharge period signal following the ignition time signal;

repeating alternately turning on and off energization of the primary coil during the multiple discharge period signal to generate the secondary current in the secondary coil both in a forward direction and in a reverse direction to carry out multiple discharge in the spark plug;

detecting the secondary current; and switching the turning on and off of the energization of the primary coil each time the secondary current reaches a predetermined discharge holding current value in the multiple discharge.

18. The multiple discharge ignition control method of claim 17 further comprising:

variably setting the discharge holding current value in accordance with an engine operation state related to an in-flow speed of air-fuel mixture gas near the spark plug.

19. A multiple discharge ignition control method for internal combustion engines having an ignition coil, a spark plug and a booster circuit, the ignition coil including a primary coil and a secondary coil connected to the spark plug, and the booster circuit including a plurality of boosting means, the multiple discharge ignition control method comprising:

generating an ignition time signal at an ignition time;

supplying a primary current to the primary coil from in response to the ignition time signal thereby to generate a secondary current in the secondary coil for starting ignition by the spark plug;

generating a multiple discharge period signal following the ignition time signal;

repeating alternately turning on and off energization of the primary coil by supplying currents of the plurality of boosting means of the booster circuit during the multiple discharge period signal to generate the secondary current in the secondary coil both in a forward direction and in a reverse direction to carry out multiple discharge in the spark plug;

detecting a total sum of the currents of the plurality of boosting means at a location where the plurality of boosting means are integrated; and controlling turn-on/off of the boosting means based on the total sum of the currents of the plurality of boosting means.

20. The multiple discharge ignition control method of claim 19 further comprising:

detecting the secondary current; and switching the turning on and off of the energization of the primary coil each time the secondary current reaches a predetermined discharge holding current value in the multiple discharge.

* * * * *